US006514678B1

(12) United States Patent
Burgmaier et al.

(10) Patent No.: US 6,514,678 B1
(45) Date of Patent: Feb. 4, 2003

(54) PHOTOTHERMOGRAPHIC MATERIALS CONTAINING SOLUBILIZED ANTIFOGGANTS

(75) Inventors: George J. Burgmaier, Pittsford, NY (US); Roger L. Klaus, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/014,961

(22) Filed: Dec. 11, 2001

(51) Int. Cl.[7] ..... G03C 1/34; G03C 1/498

(52) U.S. Cl. ..... 430/353; 430/510; 430/523; 430/607; 430/610; 430/611; 430/619

(58) Field of Search ..... 430/607, 610, 430/611, 617, 619, 510, 523, 353

(56) References Cited

U.S. PATENT DOCUMENTS

| | | | | |
|---|---|---|---|---|
| 3,874,946 A | | 4/1975 | Costa et al. | 430/617 |
| 3,877,940 A | | 4/1975 | Ericson | 430/617 |
| 3,955,982 A | | 5/1976 | VanAllan et al. | 430/617 |
| 4,108,665 A | | 8/1978 | Gutman et al. | 430/617 |
| 4,442,202 A | | 4/1984 | Shiga et al. | 430/619 |
| 4,465,761 A | | 8/1984 | Takegawa et al. | 430/341 |
| 4,546,075 A | | 10/1985 | Kitaguchi et al. | 430/617 |
| 4,756,999 A | | 7/1988 | Swain et al. | 430/619 |
| 5,340,712 A | | 8/1994 | Dunn et al. | 430/619 |
| 5,369,000 A | | 11/1994 | Sakizdeh et al. | 430/611 |
| 5,374,514 A | | 12/1994 | Kirk et al. | 430/619 |
| 5,460,938 A | | 10/1995 | Kirk et al. | 430/619 |
| 5,464,737 A | | 11/1995 | Sakizadeh et al. | 430/619 |
| 5,952,167 A | | 9/1999 | Okada et al. | 430/619 |
| 5,958,668 A | * | 9/1999 | Matsumoto et al. | 430/611 |
| 6,350,569 B1 | * | 2/2002 | Watanabe et al. | 430/617 |

OTHER PUBLICATIONS

JP Abstract 59–057234A2 Apr. 1994.
JP Abstract 61–129642 A2 Jun. 1986.
JP Abstract 07–002781 A2 Jan. 1995.
JP Abstract 50137126 Apr. 1981.

* cited by examiner

*Primary Examiner*—Richard L. Schilling
(74) *Attorney, Agent, or Firm*—J. Lanny Tucker

(57) ABSTRACT

Aqueous-based photothermographic materials have improved stability to increase in $D_{min}$ during aging by including certain water-soluble or water-dispersible antifoggants that have a pKa of 8 or less. These antifoggants are represented by Structure I:

$$R_1—SO_2—C(R_2)R_3—(CO)_m—(L)_n—SG \qquad \text{I}$$

wherein $R_1$ is an aliphatic or cyclic group, $R_2$ and $R_3$ are independently hydrogen or bromine as long as at least one of them is bromine, L is an aliphatic divalent linking group, m and n are independently 0 or 1, and SG is a solubilizing group having a pKa of 8 or less.

18 Claims, No Drawings

PHOTOTHERMOGRAPHIC MATERIALS CONTAINING SOLUBILIZED ANTIFOGGANTS

FIELD OF THE INVENTION

This invention relates to photosensitive thermally developable imaging materials. In particular, it relates to thermally developable photothermographic materials that exhibit reduced minimum density ($D_{min}$).

BACKGROUND OF THE INVENTION

Silver-containing photothermographic imaging materials that are developed with heat and without liquid development have been known in the art for many years. Such materials are used in a recording process wherein an image is formed by imagewise exposure of the photothermographic material to specific electromagnetic radiation (for example, visible, ultraviolet, or infrared radiation) and developed by the use of thermal energy. These materials, also known as "dry silver" materials, generally comprise a support having coated thereon: (a) a photosensitive catalyst (such as silver halide) that upon such exposure provides a latent image in exposed grains that are capable of acting as a catalyst for the subsequent formation of a silver image in a development step, (b) a relatively or completely non-photosensitive source of reducible silver ions, (c) a reducing composition (usually including a developer) for the reducible silver ions, and (d) a hydrophilic or hydrophobic binder. The latent image is then developed by application of thermal energy.

In such materials, the photosensitive catalyst is generally a photographic type photosensitive silver halide that is considered to be in catalytic proximity to the non-photosensitive source of reducible silver ions. Catalytic proximity requires intimate physical association of these two components either prior to or during the thermal image development process so that when silver atoms, $(Ag^0)_n$, also known as silver specks, clusters, nuclei, or latent image, are generated by irradiation or light exposure of the photosensitive silver halide, those silver atoms are able to catalyze the reduction of the reducible silver ions within a catalytic sphere of influence around the silver atoms [Klosterboer, *Imaging Processes and Materials* (*Neblette's Eighth Edition*), Sturge, Walworth & Shepp (Eds.), Van Nostrand-Reinhold, New York, Chapter 9, pp. 279–291, 1989]. It has long been understood that silver atoms act as a catalyst for the reduction of silver ions, and that the photosensitive silver halide can be placed in catalytic proximity with the non-photosensitive source of reducible silver ions in a number of different ways (see, for example, *Research Disclosure,* June 1978, item 17029). Other photosensitive materials, such as titanium dioxide, cadmium sulfide, and zinc oxide, have also been reported to be useful in place of silver halide as the photocatalyst in photothermographic materials [see for example, Shepard, *J. Appl. Photog. Eng.* 1982, 8(5), 210–212, Shigeo et al., *Nippon Kagaku Kaishi,* 1994, 11, 992–997, and FR 2,254,047 (Robillard)].

The photosensitive silver halide may be made "in situ," for example, by mixing an organic or inorganic halide-containing source with a source of reducible silver ions to achieve partial metathesis and thus causing the in situ formation of silver halide (AgX) grains throughout the silver source [see, for example, U.S. Pat. No. 3,457,075 (Morgan et al.)]. In addition, photosensitive silver halides and sources of reducible silver ions can be co-precipitated [see Usanov et al., *J. Imag. Sci. Tech.* 40, 104 (1996)]. Alternatively, a portion of the reducible silver ions can be completely converted to silver halide, and that portion can be added back to the source of reducible silver ions (see Usanov et al., International Conference on Imaging Science, 7–11 September 1998).

The silver halide may also be "preformed" and prepared by an "ex situ" process whereby the silver halide (AgX) grains are prepared and grown separately. With this technique, one has the possibility of controlling the grain size, grain size distribution, dopant levels, and composition much more precisely, so that one can impart more specific properties to both the silver halide grains and the photothermographic material. The preformed silver halide grains may be introduced prior to, and be present during, the formation of the source of reducible silver ions. Co-precipitation of the silver halide and the source of reducible silver ions provides a more intimate mixture of the two materials [see for example, U.S. Pat. No. 3,839,049 (Simons)]. Alternatively, the preformed silver halide grains may be added to and physically mixed with the source of reducible silver ions.

The non-photosensitive source of reducible silver ions is a material that contains reducible silver ions. Typically, the preferred non-photosensitive source of reducible silver ions is a silver salt of a long chain aliphatic carboxylic acid having from 10 to 30 carbon atoms, or mixtures of such salts. Such acids are also known as "fatty acids" or "fatty carboxylic acids". Silver salts of other organic acids or other organic compounds, such as silver imidazoles, silver tetrazoles, silver benzotriazoles, silver benzotetrazoles, silver benzothiazoles and silver acetylides have also been proposed. U.S. Pat. No. 4,260,677 (Winslow et al.) discloses the use of complexes of various inorganic or organic silver salts.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent for silver ion. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer(s).

Differences Between Photothermography and Photography

The imaging arts have long recognized that the field of photothermography is clearly distinct from that of photography. Photothermographic materials differ significantly from conventional silver halide photographic materials that require processing with aqueous processing solutions to provide a visible image.

As noted above, in photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example, a silver carboxylate) is used to generate the visible image using thermal development. Thus imaged, the photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. Even in so-called "instant photography", the developer chemistry is physically separated from the photosensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems during the preparation of the photothermographic emulsion as well as during coating, use, storage, and post-processing handling.

Moreover, in photothermographic materials, the unexposed silver halide generally remains intact after development and the material must be stabilized against further imaging and development. In contrast, silver halide is removed from conventional photographic materials after solution development to prevent further imaging (that is, in the aqueous fixing step).

In photothermographic materials, the binder is capable of wide variation and a number of binders (both hydrophilic and hydrophobic) are useful. In contrast, conventional photographic materials are limited almost exclusively to hydrophilic colloidal binders such as gelatin.

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Imaging Processes and Materials* (Neblette's Eighth Edition), noted above, *Unconventional Imaging Processes*, E. Brinckman et al. (Eds.), The Focal Press, London and New York, 1978, pp. 74–75, in Zou et al., *J. Imaging Sci. Technol.* 1996, 40, 94–103, and in M. R. V. Sahyun, *J. Imaging Sci. Technol.* 1998, 42, 23.

Problem to be Solved

Because the developer is incorporated within the material, photothermographic materials often suffer from fogging, or the appearance of non-image density ($D_{min}$), as soon as the materials are prepared. Fogging may occur as the materials are stored for lengthy periods of time. Thus, it has long been known that additives (antifoggants) are needed to control such fogging.

Most common photothermographic materials are prepared using organic solvents for layer formulation and coating, and therefore often identified as "solvent-based" or "non-aqueous" materials. The various chemical components required for such materials are generally soluble in the organic solvents and insoluble in water.

However, photothermographic materials that can be formulated and coated out of water ("aqueous-based" materials) would have a number of manufacturing, environmental, and cost advantages. The use of the same chemical components that are present in solvent-based materials is not always possible without the use of expensive or tedious solubilizing or dispersing techniques (for example, as slurries). The water-insoluble chemical components tend to cause precipitation, variability in photosensitive response, and increased coating defects when used in aqueous formulations.

Hence, there is a need for a means to reduce fogging in aqueous-based photothermographic materials without the use of the conventional antifoggants used in solvent-based materials.

SUMMARY OF THE INVENTION

The present invention provides a photothermographic material comprising a support having thereon at least one imaging layer comprising a hydrophilic binder, and having in reactive association:

a) a photosensitive silver halide, b) a non-photosensitive source of reducible silver ions, and c) a reducing composition for said reducible silver ions, the photothermographic material further comprising:

d) an antifoggant that has a pKa of 8 or less and is represented by the following Structure I:

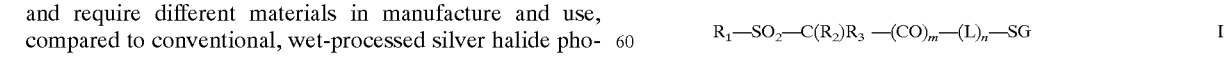

$$R_1—SO_2—C(R_2)R_3—(CO)_m—(L)_n—SG \quad \text{I}$$

wherein $R_1$ is an aliphatic or cyclic group, $R_2$ and $R_3$ are independently hydrogen or bromine as long as at least one of them is bromine, L is an aliphatic divalent linking group, m and n are independently 0 or 1, and SG is a solubilizing group having a pKa of 8 or less.

In some preferred embodiments, the antifoggants are defined using Structure I noted above wherein:

when m and n are both 0, SG is carboxy (or a salt thereof), sulfo (or a salt thereof), phospho (or a salt thereof), $—SO_2N^-COR_4M^+$, or $—N^-SO_2R_4M^+$, when m is 1 and n is 0, SG is carboxy (or salt thereof), sulfo (or a salt thereof), phospho (or a salt thereof), or $—N^-SO_2R_4M^+$, when m and n are both 1, SG is carboxy (or a salt thereof), sulfo (or a salt thereof), phospho (or a salt thereof), or $—SO_2N^-COR_4M^+$, and $R_4$ is an aliphatic or cyclic group, and $M^+$ is a cation other than a proton.

The present invention also provides a method of forming a visible image comprising:

A) imagewise exposing the photothermographic material described above to electromagnetic radiation at a wavelength greater than 400 nm to form a latent image.

B) simultaneously or sequentially, heating the exposed photothermographic material to develop the latent image into a visible image.

We have discovered that the photothermographic materials of the present invention have increased resistance to $D_{min}$ formation in both "fresh" and aged samples (for example storage). Further, these materials can be prepared using aqueous-based formulations in which the essential antifoggants are readily dispersible or soluble so aqueous-based photothermographic materials can be readily prepared. This avoids the costly and time-consuming need to prepare solid-particle dispersions of antifogging agents.

These advantages are achieved by using novel solubilized antifoggants shown in Structure I above. These compounds can be included in any layer of the photothermographic material because they are believed to migrate throughout the various aqueous-based layers. Preferably, they are placed in one or more imaging layers as defined in more detail below.

DETAILED DESCRIPTION OF THE INVENTION

The photothermographic materials of this invention can be used, for example, in conventional black-and-white or color photothermography, in electronically generated black-and-white or color hardcopy recording. They can be used in microfilm applications, in radiographic imaging (for example digital medical imaging), and industrial radiography. They can also be used in the graphic arts area (for example, imagesetting and phototypesetting), in the manufacture of printing plates, and in proofing. Furthermore, the absorbance of these photothermographic materials between 350 and 450 nm is sufficiently low (less than 0.5) to permit their use in graphic arts applications such as contact printing, proofing, and duplicating ("duping"). The photothermographic materials prepared by the present invention are preferably used to obtain black-and-white images.

In the photothermographic materials, the components of the imaging layer can be in one or more layers. The layer(s) that contain a photo-sensitive silver halide and non-photosensitive source of reducible silver ions, or both, are referred to herein as emulsion layer(s). The photosensitive silver halide and the non-photosensitive source of reducible silver ions are in catalytic proximity and preferably in the same emulsion layer.

Various layers are usually disposed on the "backside" (non-emulsion or non-imaging side) of the materials, including antihalation layer(s), protective layers, antistatic layers, conducting layers, and transport enabling layers.

Various layers are also usually disposed on the "frontside", imaging, or emulsion side of the support, including protective topcoat layers, primer layers, interlayers, opacifying layers, antistatic layers, antihalation layers, acutance layers, auxiliary layers, and others readily apparent to one skilled in the art.

The process for the formation of a visible image (usually a black-and-white image) comprises first exposing to electromagnetic radiation and hereafter heating the photothermographic material. Thus, the imaging process generally comprises:

A) imagewise exposing the photothermographic material to electromagnetic radiation to which the photosensitive silver halide of the material is sensitive, to generate a latent image, and B) simultaneously or sequentially, heating the exposed material to develop the latent image into a visible image.

In some other embodiments, the imaging method it utilized with photothermographic materials having transparent supports and further comprises.

C) positioning the exposed and heat-developed photothermographic material with a visible image thereon between a source of imaging radiation and an imageable material that is sensitive to the imaging radiation, and D) thereafter exposing the imageable material to the imaging radiation through the visible image in the exposed and heat-developed photothermographic material to provide a visible image in the imageable material.

This visible image can also be used as a mask for exposure of other photosensitive imageable materials, such as graphic arts films, proofing films, printing plates and circuit board films, that are sensitive to suitable imaging radiation (for example UV radiation). This can be done by imaging an imageable material (such as a photopolymer, a diazo material, a photoresist, or a photosensitive printing plate) through the exposed and heat-developed photothermographic material using steps C) and D) noted above.

When the photothermographic materials are heat-developed as described below in a substantially water-free condition after, or simultaneously with, imagewise exposure, a silver image (preferably a black-and-white silver image) is obtained. The photothermographic material may be exposed in step A using ultraviolet, visible, infrared or laser radiation using an infrared laser, a laser diode, an infrared laser diode, a light-emitting screen, a CRT tube, a light-emitting diode, or other light or radiation source readily apparent to one skilled in the art.

Definitions

As used herein:

In the descriptions of the photothermographic materials prepared from the practice of the present invention, "a" or "an" component refers to "at least one" of that component.

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Macmillan 1977, p. 374.

"Photothermographic material(s)" means a construction comprising at least one photothermographic emulsion layer or a photothermographic set of layers (wherein the photosensitive silver halide and the non-photosensitive source of reducible silver ions are in one layer and the other components or additives are distributed, as desired, in an adjacent coating layer) and any supports, topcoat layers, image-receiving layers, blocking layers, antihalation layers, subbing or priming layers. These materials also include multilayer constructions in which one or more imaging components are in different layers, but are in "reactive association" so that they readily come into contact with each other during imaging and/or development. For example, one layer can include the non-photosensitive source of reducible silver ions and another layer can include the reducing composition, but the two reactive components are in reactive association with each other.

"Photothermographic emulsion" or "emulsion" refers to a dispersion that comprises as essential components: at least one photosensitive silver halide and at least one non-photosensitive source of reducible silver ions. As is well known in the art, the emulsion can include many other components and addenda that described in more detail below. These layers are usually on what is known as the "frontside" of the support.

"Non-photosensitive" means not intentionally light sensitive.

The sensitometric terms "photospeed" or "photographic speed" (also known as "sensitivity"), "contrast", $D_{min}$, and $D_{max}$, have conventional definitions known in the imaging arts.

"Transparent" means capable of transmitting visible light or imaging radiation without appreciable scattering or absorption.

"Hydrophilic" means that the compound so defined is compatible (soluble or readily dispersible in) an aqueous solvent that includes at least 50 volume % water.

As is well understood in this art, for the various essential antifogging compounds described herein, substitution is not only tolerated, but is often advisable and various substituents are anticipated on the compounds used in the present invention. Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl"). For example, where a benzene ring structure is shown (including fused ring structures), substituent groups may be placed on the benzene ring structure, but the atoms making up the benzene ring structure may not be replaced.

As a means of simplifying the discussion and recitation of certain substituent groups, the term "group" refers to chemical species that may be substituted as well as those that are not so substituted. Thus, the term "group," such as "alkyl group" is intended to include not only pure hydrocarbon alkyl chains, such as methyl, ethyl, propyl, t-butyl, cyclohexyl, iso-octyl, octadecyl and the like, but also alkyl chains bearing substituents known in the art, such as hydroxyl, alkoxy, phenyl, halogen atoms (F, Cl, Br, and I), cyano, nitro, amino, carboxy and the like. For example, alkyl group includes ether and thioether groups (for example $CH_3$—$CH_2$—$CH_2$—O—$CH_2$—or $CH_3$—$CH_2$—$CH_2$—S—$CH_2$—), haloalkyl, nitroalkyl, carboxyalkyl, hydroxyalkyl, sulfoalkyl, and other groups readily apparent to one skilled in the art. Substituents that adversely react with other active ingredients, such as very strongly electrophilic or oxidizing substituents, would, of course, be excluded by the ordinarily skilled artisan as not being inert or harmless.

*Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y. 10011).

Other aspects, advantages, and benefits of the present invention are apparent from the detailed description, examples, and claims provided in this application.

The Photocatalyst

As noted above, the photothermographic materials of the present invention include one or more photocatalysts in the photothermographic emulsion layer(s). Useful photocatalysts are typically silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. Silver bromide and silver bromoiodide are more preferred, with the latter silver halide having up to 10 mol % silver iodide. Typical techniques for preparing and precipitating silver halide grains are described in *Research Disclosure,* 1978, Item 17643.

The shape of the photosensitive silver halide grains used in the resent invention is in no way limited. The silver halide grains may have any crystalline habit including, but not limited to, cubic, octahedral, rhombic, dodecahedral, orthorhombic, tetrahedral, other polyhedral, laminar, twinned, platelet, or tabular morphologies and may have epitaxial growth of crystals thereon. If desired, a mixture of these crystals can be employed. Silver halide grains having cubic and tabular morphology are preferred.

The silver halide grains may have a uniform ratio of halide throughout. They may have a graded halide content, with a continuously varying ratio of, for example, silver bromide and silver iodide or they may be of the core-shell type, having a discrete core of one halide ratio, and a discrete shell of another halide ratio. Core-shell silver halide grains useful in photothermographic materials and methods of preparing these materials are described for example in U.S. Pat. No. 5,382,504 (Shor et al.) incorporated herein by reference. Iridium and/or copper doped core-shell and non-core-shell grains are described in U.S. Pat. No. 5,434,043 (Zou et al.) and U.S. Pat. No. 5,939,249 (Zou), incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halides be preformed and prepared by an ex-situ process. The silver halide grains prepared ex-situ may then be added to and physically mixed with the non-photosensitive source of reducible silver ions. It is more preferable to form the source of reducible silver ions in the presence of ex-situ-prepared silver halide. In this process, the source of reducible silver ions, such as a long chain fatty acid silver carboxylate (commonly referred to as a silver "soap"), is formed in the presence of the preformed silver halide grains. Co-precipitation of the reducible source of silver ions in the presence of silver halide provides a more intimate mixture of the two materials [see, for example U.S. Pat. No. 3,839,049 (Simons)]. Materials of this type are often referred to as "preformed soaps."

The silver halide grains used in the imaging formulations can vary in average diameter of up to several micrometers ($\mu$m) depending on their desired use. Preferred silver halide grains are those having an average particle size of from about 0.01 to about 1.5 $\mu$m, more preferred are those having an average particle size of from about 0.03 to about 1.0 $\mu$m, and most preferred are those having an average particle size of from about 0.05 to about 0.8 μm. Those of ordinary skill in the art understand that there is a finite lower practical limit for silver halide grains that is partially dependent upon the wavelengths to which the grains are spectrally sensitized. Such a lower limit, for example, is typically from about 0.01 to about 0.005 μm.

The average size of the photosensitive doped silver halide grains is expressed by the average diameter if the grains are spherical, and by the average of the diameters of equivalent circles for the projected images if the grains are cubic or in other non-spherical shapes.

Grain size may be determined by any of the methods commonly employed in the art for particle size measurement. Representative methods are described by in "Particle Size Analysis," ASTM Symposium on Light Microscopy, R. P. Loveland, 1955, pp. 94–122, and in C. E. K. Mees and T. H. James, *The Theory of the Photographic Process,* Third Edition, Chapter 2, Macmillan Company, 1966. Particle size measurements may be expressed in terms of the projected areas of grains or approximations of their diameters. These will provide reasonably accurate results if the grains of interest are substantially uniform in shape.

Preformed silver halide emulsions used in the material of this invention can be prepared by aqueous or organic processes and can be unwashed or washed to remove soluble salts. In the latter case, the soluble salts can be removed by ultrafiltration, by chill setting and leaching, or by washing the coagulum [for example, by the procedures described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.), and U.S. Pat. No. 2,489,341 (Waller et al.)].

It is also effective to use an in situ process in which a halide-containing compound is added to an organic silver salt to partially convert the silver of the organic silver salt to silver halide. The halogen-containing compound can be inorganic (such as zinc bromide or lithium bromide) or organic (such as N-bromosuccinimide).

In some instances, it may be helpful to prepare the photosensitive silver halide grains in the presence of a hydroxytetraazindene (such as 4-hydroxy-6-methyl-1,3,3, 3a,7-tetraazaindene) or an N-heterocyclic compound comprising at least one mercapto compound (such as 1-phenyl-5-mercaptotetrazole) to provide increased photospeed. Details of this procedure are provided in copending and commonly assigned U.S. Ser. No. 09/833,533 (filed Apr. 12, 2001 by Shor, Zou, Ulrich, and Simpson) that is incorporated herein by reference.

Additional methods of preparing these silver halide and organic silver salts and manners of blending them are described in *Research Disclosure*, June 1978, item 17029, U.S. Pat. No. 3,700,458 (Lindholm) and U.S. Pat. No. 4,076,539 (Ikenoue et al.), and JP Applications 13224/74, 42529/76, and 17216/75.

Preferably, the photosensitive silver halide(s) used in the practice of this invention are provided as a hydrophilic photosensitive silver halide emulsion comprising one or more hydrophilic binders and/or peptizers. Most likely the photosensitive silver halide emulsion includes one or more conventional peptizers that are well known to one skilled in the art, including but not limited to, gelatino peptizers such as phthalated gelatin, non-phthalated gelatin, and acid or base hydrolyzed gelatins. The amount of peptizer in this emulsion will dependent upon such factors as the particular photosensitive silver halide, the desired image, the particular components of the photothermographic emulsion, and coating conditions. In some embodiments, the peptizer(s) is present in an amount of from about 5 to about 40 g/mol silver from the silver halide. Useful procedures for preparing such photosensitive silver halide emulsions are described for example in Product Licensing Index, Vol., 92, Item 9232, December 1971 (now know as *Research Disclosure*).

The one or more light-sensitive silver halides used in the photothermographic materials of the present invention are preferably present in an emulsion (imaging) layer in an amount of from about 0.005 to about 0.5 mole, more preferably from about 0.01 to about 0.25 mole per mole, and most preferably from about 0.03 to about 0.15 mole, per mole of non-photosensitive source of reducible silver ions.

Chemical and Spectral Sensitizers

The photosensitive silver halides used in the invention may be employed without modification. However, they are preferably chemically and/or spectrally sensitized in a manner similar to that used to sensitize conventional wet-processed silver halide photographic materials or state-of-the-art heat-developable photothermographic materials.

Thus, the photothermographic material may be chemically sensitized with one or more chemical sensitizing agents, such as a compound containing sulfur, selenium, or tellurium, or with a compound containing gold, platinum, palladium, ruthenium, rhodium, iridium, or combinations thereof, a reducing agent such as a tin halide or a combination of any of these. The details of these procedures are described in T. H. James, *The Theory of the Photographic Process,* Fourth Edition, Chapter 5, pp. 149–169. Suitable chemical sensitization procedures are also disclosed in U.S. Pat. No. 1,623,499 (Sheppard et al.), U.S. Pat. No. 2,399,083 (Waller et al.), U.S. Pat. No. 3,297,447 (McVeigh), and U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), and EP-A-0 915 371 (Lok et al.).

One method of chemical sensitization is by oxidative decomposition of a spectral sensitizing dye in the presence of a photothermographic emulsion, as described in U.S. Pat. No. 5,891,615 (Winslow et al.), incorporated herein by reference.

Sulfur-containing chemical sensitizers useful in the present invention are well known in the art and described for example, in Sheppard et al., *J. Franklin Inst.,* 1923, 196, pp.653 and 673, C. E. K. Mees and T. H. James, *The Theory of the Photographic Process,* $4^{th}$ Edition, 1977, pp. 152–3, Tani, T., Photographic Sensitivity: Theory and Mechanisms, Oxford University Press, N.Y., 1995, pp. 167–176, U.S. Pat. No. 5,891,615 (Winslow et al.), Zavlin et al., IS&T's $48^{th}$ Annual Conference Papers, May 7–11, 1995 Washington D.C., pp. 156–6), U.S. Pat. No. 4,810,626 (Burgmaier et al.), U.S. Pat. No. 4,036,650 (Kobayashi et al.), U.S. Pat. No. 4,213,784 (Ikenoue et al.), and U.S. Pat. No. 4,207,108 (Hiller).

Particularly useful sulfur-containing chemical sensitizers are tetrasubstituted thiourea compounds, preferably such thiourea compounds that are substituted with the same or different aliphatic substituents, and more preferably such thiourea compounds that are substituted with the same aliphatic substituent. Such useful thioureas are described for example in U.S. Pat. No. 5,843,632 (Eshelman et al.) and in copending and commonly assigned U.S. Ser. No. 09/667, 748 (filed Sept. 21, 2000 by Lynch, Simpson, Shor, Willett, and Zou), incorporated herein by reference.

Particularly, useful tellurium-containing chemical sensitizing compounds are described in copending and commonly assigned U.S. Ser. No. 09/975,909 (filed Oct. 11, 2001 by Lynch, Opatz, Shor, Simpson, Willett, and Gysling), incorporated herein by reference.

Useful combinations of sulfur- or tellurium-containing chemical sensitizers with gold(III)-containing chemical sensitizers are described in copending and commonly assigned U.S. Ser. No. 09/768,094 (filed Jan. 23, 2001 by Simpson, Whitcomb, and Shor), incorporated herein by reference.

The total amount of chemical sensitizers that may be used during formulation of the photographic imaging composition will generally vary depending upon the average size of silver halide grains. The total amount is generally at least $10^{-10}$ mole per mole of total silver, and preferably from $10^{-8}$ to about $10^{-2}$ mole per mole of total silver for silver halide grains having an average size of from about 0.01 to about 2 μm. The upper limit can vary depending upon the compound used, the level of silver halide and the average grain size, and it would be readily determinable by one of ordinary would be readily determinable by one of ordinary skill in the art.

In general, it may also be desirable to add spectral sensitizing dyes to enhance silver halide sensitivity to ultraviolet, visible and infrared light. Thus, the photosensitive silver halides may be spectrally sensitized with various dyes that are known to spectrally sensitize silver halide. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. The cyanine dyes, merocyanine dyes and complex merocyanine dyes are particularly useful. Suitable sensitizing dyes such as those described in U.S. Pat. No. 3,719,495 (Lea), U.S. Pat. No. 5,393,654 (Burrows et al.), U.S. Pat. No. 5,441,866 (Miller et al.) and U.S. Pat. No. 5,541,054 (Miller et al.), U.S. Pat. No. 5,281,515 (Delprato et al.), and U.S. Pat. No. 5,314,795 (Helland et al.) are effective in the practice of the invention. All of the patents above are incorporated herein by reference.

An appropriate amount of spectral sensitizing dye added is generally about $10^{-10}$ to $10^{-1}$ mole, and preferably, about $10^{-7}$ to $10^{-2}$ mole per mole of silver halide.

To further control the properties of photothermographic materials, (for example, contrast, $D_{min}$, speed, or fog), it may be preferable to add one or more heteroaromatic mercapto compounds or heteroaromatic disulfide compounds as "supersensitizers". Examples include compounds of the formulae: Ar—S—M and Ar—S—S—Ar, wherein M represents a hydrogen atom or an alkali metal atom and Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Compounds having other heteroaromatic rings and compounds providing enhanced sensitization at other wavelengths are also envisioned to be suitable. Many of the above compounds are described in EP-A-0 559 228 (Philip Jr. et al.) as supersensitizers.

The heteroaromatic ring may also carry substituents. Examples of preferred substituents are halo groups (such as bromo and chloro), hydroxy, amino, carboxy, alkyl groups (for example, of 1 or more carbon atoms and preferably 1 to 4 carbon atoms), and alkoxy groups (for example, of 1 or more carbon atoms and preferably of 1 to 4 carbon atoms).

Heteroaromatic mercapto compounds are most preferred. Examples of preferred heteroaromatic mercapto compounds are 2-mercaptobenzimidazole, 2-mercapto-5-methylbenzimidazole, 2-mercaptobenzothiazole and 2-mercaptobenzoxazole, and mixtures thereof.

If used, a heteroaromatic mercapto compound is generally present in an emulsion layer in an amount of at least about 0.0001 mole per mole of total silver in the emulsion layer. More preferably, the heteroaromatic mercapto compound is present within a range of about 0.001 mole to about 1.0 mole, and most preferably, about 0.005 mole to about 0.2 mole, per mole of total silver.

Non-Photosensitive Reducible Silver Source Material

The non-photosensitive source of reducible silver ions used in photothermographic materials of the present invention can be any material that contains reducible silver ions in catalytic association with the photosensitive silver halide. Preferably, it is a silver salt that is comparatively stable to light and forms a silver image when heated to 80° C. or higher in the presence of an exposed photosensitive silver halide and a reducing agent.

Silver salts of organic acids, particularly silver salts of long-chain carboxylic (fatty) acids are preferred. The chains typically contain 10 to 30, and preferably 15 to 28, carbon atoms. Suitable organic silver salts include silver salts of organic compounds having a carboxylic acid group. Examples thereof include a silver salt of an aliphatic carboxylic acid or a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. It is particularly useful to have at least silver behenate.

Preferred examples of the silver salts of aromatic carboxylic acid and other carboxylic acid group-containing compounds include, but are not limited to, silver benzoates, a silver substituted-benzoate, such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, silver gallate, silver tannate, silver phthalate, silver terephthalate, silver salicylate, silver phenylacetate, silver pyromellitate, a silver salt of 3-carboxymethyl-4-methyl-4-thiazoline-2-thione or others as described in U.S. Pat. No. 3,785,830 (Sullivan et al.), and silver salts of aliphatic carboxylic acids containing a thioether group as described in U.S. Pat. No. 3,330,663 (Weyde et al.). Soluble silver carboxylates comprising hydrocarbon chains incorporating ether or thioether linkages, or sterically hindered substitution in the α-(on a hydrocarbon group) or ortho- (on an aromatic group) position, and displaying increased solubility in coating solvents and providing coatings with less light scattering can also be used. Such silver carboxylates are described in U.S. Pat. No. 5,491,059 (noted above). Mixtures of any of the silver salts described herein can also be used if desired.

Silver salts of sulfonates are also useful in the practice of this invention. Such materials are described for example in U.S. Pat. No. 4,504,575 (Lee). Silver salts of sulfosuccinates are also useful as described for example in EP-A-0 227 141 (Leenders et al.).

Silver salts of compounds containing mercapto or thione groups and derivatives thereof can also be used. Preferred examples of these compounds include, but are not limited to, a silver salt of 3-mercapto-4-phenyl-1,2,4-triazole, a silver salt of 2-mercaptobenzimidazole, a silver salt of 2-mercapto-5-amino-thiadiazole, a silver salt of 2-(2-ethylglycolamido)benzothiazole, silver salts of thioglycolic acids (such as a silver salt of a S-alkylthioglycolic acid, wherein the alkyl group has from 12 to 22 carbon atoms), silver salts of dithiocarboxylic acids (such as a silver salt of dithioacetic acid), a silver salt of thioamide, a silver salt of 5-carboxylic-1-methyl-2-phenyl-4-thiopyridine, a silver salt of mercaptotriazine, a silver salt of 2-mercaptobenzoxazole, silver salts as described in U.S. Pat. No. 4,123,274 (Knight et al.) (for example, a silver salt of a 1,2,4-mercaptothiazole derivative, such as a silver salt of 3-amino-5-benzylthio-1,2,4-thiazole), and a silver salt of thione compounds [such as a silver salt of 3-(2-carboxyethyl)-4-methyl-4-thiazoline-2-thione as described in U.S. Pat. No. 3,201,678 (Meixell)].

Furthermore, a silver salt of a compound containing an imino group can be used. Preferred examples of these compounds include, but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Moreover, silver salts of acetylenes can also be used as described, for example in U.S. Pat. No. 4,761,361 (Ozaki et al.) and U.S. Pat. No. 4,775,613 (Hirai et al.).

It is also convenient to use silver half soaps. A preferred example of a silver half soap is an equimolar blend of silver carboxylate and carboxylic acid, which analyzes for about 14.5% by weight solids of silver in the blend and which is prepared by precipitation from an aqueous solution of the sodium salt of a commercial fatty carboxylic acid, or by addition of the free fatty acid to the silver soap. For transparent films a silver carboxylate full soap, containing not more than about 15% of free carboxylic acid and analyzing for about 22% silver, can be used. For opaque photothermographic materials, different amounts can be used.

Another useful source of non-photosensitive reducible silver ions in the practice of this invention are the silver dimer compounds that comprise two different silver salts as described in copending U.S. Ser. No. 09/812,597 filed Mar. 20, 2001 by Whitcomb and entitled "Asymmetric Silver Salt Dimers and Imaging Compositions, Materials and Methods Using Same" that is based on Provisional Application 60/201,857 filed May 4, 2000. Such non-photosensitive silver dimer compounds comprise two different silver salts, provided that when the two different silver salts comprise straight-chain, saturated hydrocarbon groups as the silver coordinating ligands, those ligands differ by at least 6 carbon atoms.

In addition, the non-photosensitive silver compounds can be prepared as mixtures of non-photosensitive silver compounds. One such mixture can be prepared by the sequential formation of a second non-photosensitive silver compound in the presence of a previously prepared non-photosensitive silver compound. Such compounds have been referred to as "core-shell" silver salts. The preparation of such compositions would be readily apparent from the teaching provided herein as well as that provided in copending and commonly assigned U.S. Ser. No. 09/761,954 filed Jan. 17, 2001 by Whitcomb and Pham.

The methods used for making silver soap dispersions are well known in the art and are disclosed in *Research Disclosure,* April 1983, item 22812, *Research Disclosure,* October 1983, item 23419, U.S. Pat. No. 3,985,565 (Gabrielsen et al.) and the references cited above.

It is particularly preferred that the non-photosensitive source of reducible silver ions be provided in the form of an aqueous nanoparticulate dispersion of silver salt particles (such as silver carboxylate particles). The silver salt particles in such dispersions generally have a weight average particle size of less than 1000 nm when measured by any useful technique such as sedimentation field flow fractionation, photon correlation spectroscopy, or disk centrifugation. Obtaining such small silver salt particles can be achieved using a variety of techniques that are described in the copending applications identified in the following paragraphs, but generally they are achieved using high speed milling using a device such as those manufactured by Morehouse-Cowles and Hochmeyer. The details for such milling are well known in the art.

Such dispersions also advantageously include a surface modifier so the silver salt can more readily be incorporated into aqueous-based photothermographic formulations. Useful surface modifiers include, but are not limited to, vinyl polymers having an amino moiety, such as polymers prepared from acrylamide, methacrylamide, or derivatives thereof, as described in copending and commonly assigned U.S. Ser. No. 09/764,677 filed Jan. 18, 2001 by Lelental, Pill, Dickinson, Wakley, and Ghyzel as a CIP of U.S. Ser. No. 09/502,125 filed Feb. 10, 2000, now abandoned, both incorporated herein by reference. A particularly useful surface modifier is dodecylthiopolyacrylamide that can be prepared as described in the noted copending application using the teaching provided by Pavia et al., *Makromolecular Chemie,* 193(9), 1992, pp. 2505–17.

Other useful surface modifiers are phosphoric acid esters, such as mixtures of mono- and diesters of orthophosphoric acid and hydroxy-terminated, oxyethylated long-chain alcohols or oxyethylated alkyl phenols as described for example in U.S. Ser. No. 09/764,665 filed Jan. 18, 2001 by Lelental, Dickinson, and Wakley as a CIP of U.S. Ser. No. 09/501,815 filed Feb. 10, 2000, now abandoned, both incorporated herein by reference. Particularly useful phosphoric acid esters are commercially available from several manufacturers under the trademarks or tradenames EMPHOS™ (Witco Corp.), RHODAFAC (Rhone-Poulenc), T-MULZ® (Hacros Organics), and TRYFAC (Henkel Corp./Emery Group).

Such dispersions contain smaller particles and narrower particle size distributions than dispersions that lack such surface modifiers. Particularly useful nanoparticulate dispersions are those comprising silver carboxylates such as silver salts of long chain fatty acids having from 8 to 30 carbon atoms, including, but not limited to, silver behenate, silver caprate, silver hydroxystearate, silver myristate, silver palmitate, and mixtures thereof. Silver behenate nanoparticulate dispersions are most preferred. These nanoparticulate dispersions can be used in combination with the conventional silver salts described above, including but not limited to, silver benzotriazole, silver imidazole, and silver benzoate.

The one or more non-photosensitive sources of reducible silver ions are preferably present in an amount of about 5% by weight to about 70% by weight, and more preferably, about 10% to about 50% by weight, based on the total dry weight of the emulsion layer. Stated another way, the amount of the sources of reducible silver ions is generally present in an amount of from about 0.001 to about 0.2 mol/m$^2$ of the dry photothermographic material, and preferably from about 0.01 to about 0.05 mol/m$^2$ of that material.

The total amount of silver (from all silver sources) in the photothermographic materials is generally at least 0.002 mol/m$^2$ and preferably from about 0.01 to about 0.05 mol/m$^2$.

Reducing Agents

For black-and-white imaging materials, the reducing agent (or reducing agent composition comprising two or more components) for the nonphotosensitive source of reducible silver ions can be any material, preferably an organic material, that can reduce silver (I) ion to metallic silver. Conventional photographic developers such as methyl gallate, hydroquinone, substituted hydroquinones, hindered phenols, amidoximes, azines, catechol, pyrogallol, ascorbic acid (and derivatives thereof), hydroxylamine and derivatives thereof, phenylenediamine developing agents, aminophenol developing agents, 3-pyrazolidones, hydroxytetronamide developing agents, reductone developing agents, sulfonamidophenol developing agents, leuco dyes and other materials readily apparent to one skilled in the art can be used in this manner as described for example in U.S. Pat. No. 6,020,117 (Bauer et al.), incorporated herein by reference. Sulfonamidophenol developing agents, such as described in Belgian Patent 802,519 are especially useful as reducing agents.

In some instances, the reducing agent composition comprises two or more components such as a hindered phenol developer and a co-developer that can be chosen from the various classes of reducing agents described below. Ternary developer mixtures involving the further addition of contrast enhancing agents are also useful. Such contrast enhancing agents can be chosen from the various classes of reducing agents described below.

Hindered phenol reducing agents are preferred (alone or in combination with one or more co-developers and contrast enhancing agents). These are compounds that contain only one hydroxy group on a given phenyl ring and have at least one additional substituent located ortho to the hydroxy group. Hindered phenol developers may contain more than one hydroxy group as long as each hydroxy group is located on different phenyl rings. Hindered phenol developers include, for example, binaphthols (that is dihydroxybinaphthyls), biphenols (that is dihydroxybiphenyls), bis(hydroxynaphthyl)methanes, bis(hydroxyphenyl)methanes, hindered phenols, and hindered naphthols each of which may be variously substituted, many of which are described in U.S. Pat. No. 3,094,417 (Workman) and U.S. Pat. No. 5,262,295 (Tanaka et al.), both incorporated herein by reference.

More specific alternative reducing agents that have been disclosed in dry silver systems including amidoximes such as phenylamidoxime, 2-thienylamidoxime and p-phenoxyphenylamidoxime, azines (for example, 4-hydroxy-3,5-dimethoxybenzaldehydrazine), a combination of aliphatic carboxylic acid aryl hydrazides and ascorbic acid, such as 2,2'-bis(hydroxymethyl)-propionyl-β-phenyl hydrazide in combination with ascorbic acid, a combination of polyhydroxybenzene and hydroxylamine, a reductone and/or a hydrazine [for example, a combination of hydroquinone and bis(ethoxyethyl)hydroxylamine], piperidinohexose reductone or formyl-4-methylphenylhydrazine, hydroxamic acids (such as phenylhydroxamic acid, p-hydroxyphenylhydroxamic acid, and o-alaninehydroxamic acid), a combination of azines and sulfonamidophenols (for example, phenothiazine and 2,6-dichloro-4-benzenesulfonamidophenol), α-cyanophenylacetic acid derivatives (such as ethyl α-cyano-2-methylphenylacetate and ethyl α-cyanophenylacetate), bis-o-naphthols [such as 2,2'-dihydroxyl-1-binaphthyl, 6,6'-dibromo-2,2'-dihydroxy-1,1'-binaphthyl, and bis(2-hydroxy-1-naphthyl)methane], a combination of bis-o-naphthol and a 1,3-dihydroxybenzene derivative (for example, 2,4-dihydroxybenzophenone or 2,4-dihydroxyacetophenone), 5-pyrazolones such as 3-methyl-1-phenyl-5-pyrazolone, reductones (such as dimethylaminohexose reductone, anhydrodihydro-aminohexose reductone and anhydrodihydro-piperidone-hexose reductone), sulfonamidophenol reducing agents (such as 2,6-dichloro-4-benzenesulfonamidophenol, and p-benzenesulfonamidophenol), 2-phenylindane-1,3-dione and similar compounds, chromans (such as 2,2-dimethyl-7-t-butyl-6-hydroxychroman), 1,4-dihydropyridines (such as 2,6-dimethoxy-3,5-dicarbethoxy-1,4-dihydropyridine), ascorbic acid derivatives (such as 1-ascorbylpalmitate, ascorbylstearate and unsaturated aldehydes and ketones), 3-pyrazolidones, and certain indane-1,3-diones.

An additional class of reducing agents that can be used as developers are substituted hydrazines including the sulfonyl hydrazides described in U.S. Pat. No. 5,464,738 (Lynch et al.). Still other useful reducing agents are described, for example, in U.S. Pat. No. 3,074,809 (Owen), U.S. Pat. No. 3,094,417 (Workman), U.S. Pat. No. 3,080,254 (Grant, Jr.), and U.S. Pat. No. 3,887,417 (Klein et al.). Auxiliary reducing agents may be useful as described in U.S. Pat. No. 5,981,151 (Leenders et al.).

Co-developer reducing agents can also be used as described for example, in copending U.S. Ser. No. 09/239,182 (filed Jan. 28, 1999 by Lynch and Skoog), incorporated herein by reference. Examples of these compounds include, but are not limited to, 2,5-dioxo-cyclopentane carboxaldehydes, 5-(hydroxymethylene)-2,2-dimethyl-1,3-dioxane-4,6-diones, 5-(hydroxymethylene)-1,3-dialkylbarbituric acids, and 2-(ethoxymethylene)-1H-indene-1,3(2H)-diones.

Additional classes of reducing agents that can be used as co-developers are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). All of the patents noted above are incorporated herein by reference.

Yet another class of co-developers includes substituted acrylonitrile compounds as described in U.S. Pat. No. 5,635,339 (Murray) and U.S. Pat. No. 5,545,515 (Murray et al.), both incorporated herein by reference. Examples of such compounds include, but are not limited to, the compounds identified as HET-01 and HET-02 in U.S. Pat. No. 5,635,339 (noted above) and CN-01 through CN-13 in U.S. Pat. No. 5,545,515 (noted above). Particularly useful compounds of this type are (hydroxymethylene)cyanoacetates and their metal salts.

Various contrast enhancers can be used in some photothermographic materials with specific co-developers. Examples of useful contrast enhancers include, but are not limited to, hydroxylamines (including hydroxylamine and alkyl- and aryl-substituted derivatives thereof), alkanolamines and ammonium phthalamate compounds as described for example, in U.S. Pat. No. 5,545,505 (Simpson), hydroxamic acid compounds as described for example, in U.S. Pat. No. 5,545,507 (Simpson et al.), N-acylhydrazine compounds as described for example, in U.S. Pat. No. 5,558,983 (Simpson et al.), and hydrogen atom donor compounds as described in U.S. Pat. No. 5,637,449 (Harring et al.). All of the above patents are incorporated herein by reference.

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the emulsion layer coating.

Essential Antifoggants

The photothermographic materials of this invention include one or more water-soluble or water-dispersible antifoggants that have a pKa of 8 or less. In addition, they are represented by the following Structure I:

$$R_1—SO_2—C(R_2)R_3—(CO)_m—(L)_n—SG \quad \text{I}$$

wherein $R_1$ is a substituted or unsubstituted aliphatic or cyclic group of any size as long as the antifoggant remains soluble or readily dispersible in water. Substituted or unsubstituted aliphatic groups for $R_1$ include monovalent groups having 1 to 20 carbon, nitrogen, sulfur, and oxygen atoms in the chain including, but not limited to, chains that include one or more substituted or unsubstituted alkyl groups (having 1 to 10 carbon atoms), substituted or unsubstituted alkenylene groups (having 2 to 20 carbon atoms), substituted or unsubstituted alkylenearylene groups (having 7 to 20 carbon atoms in the chain), and combinations of any of these groups, as well as combinations of these groups that are connected with one or more amino, amido, carbonyl, sulfonyl, carbonamido, sulfonamido, thio, oxy, oxycarbonyl, oxysulfonyl, and other connecting groups that would be readily apparent to one skilled in the art. The various types of useful aliphatic groups would be readily apparent to one skilled in the art.

Preferred aliphatic groups for $R_1$ include substituted or unsubstituted t-butyl and trifluoromethyl groups.

$R_1$ can also be substituted or unsubstituted cyclic groups including substituted or unsubstituted carbocyclic aryl groups (having 6 to 14 carbon atoms to form the cyclic ring), substituted or unsubstituted cycloalkylene groups (having 5 to 10 carbon atoms to form the cyclic ring) and heterocyclic groups (having 5 to 10 carbon, nitrogen, sulfur, or oxygen atoms to form the cyclic ring), both aromatic and nonaromatic. The various types of cyclic groups would be readily apparent to one skilled in the art.

Preferred cyclic groups for $R_1$ include substituted or unsubstituted aryl groups having 6 to 10 carbon atoms to form the cyclic ring. Substituted or unsubstituted phenyl groups are most preferred. Methyl groups are preferred substituents on the phenyl group.

More preferably, $R_1$ is 4-methylphenyl, phenyl, trifluoromethyl, adamantyl, or tertiary butyl.

In Structure I, $R_2$ and $R_3$ are independently hydrogen or bromine as long as one of them is bromine. Preferably, both $R_2$ and $R_3$ are bromine.

In addition, L is a substituted or unsubstituted aliphatic divalent linking group that can have the same definition as $R_1$ except that L is divalent. Thus, one skilled in the art would be able to determine suitable L groups that would serve the desired purpose while maintaining compound water solubility or dispersibility. Preferably, L is an —NH-alkylene group wherein "alkylene" is substituted or unsubstituted and has 1 to 10 carbon atoms (more preferably 1 to 3 carbon atoms).

When m and n are each 1, L is preferably an —N($CH_3$)-alkylene- or —NH-alkylene- group.

Substituents on $R_1$ and L can be any chemical moiety that would not adversely affect the desired function of the antifoggant and can include, but are not limited to, alkyl, aryl, heterocyclic, cycloalkyl, amino, carboxy, hydroxy, phospho, sulfonamido, sulfo, and other groups that would be readily apparent to one skilled in the art. The number of substituents is limited only by the number of available valences (available hydrogen atoms). Alkyl groups are preferred substituents for cyclic $R_1$ groups. However, as would be apparent, the antifoggants can have multiple sulfo, carboxy, phospho, and sulfonamido groups that impart water solubility to the molecule.

Further, in Structure I, m and n are independently 0 or 1, and preferably, both are 1.

SG can be any solubilizing group having a pKa of 8 or less that does not interfere with its antifogging activity. SG may be in the free acid form or it may be a salt, particularly a suitable metal salt (for example, an alkali metal salt) or ammonium ion salt. Preferably, SG is a salt. When SG is in its free acid form, the salt can be generated in situ by neutralization with any basic material commonly used by one skilled in the art. Preferably, SG is a carboxy, phospho, sulfo, or sulfonamido group. When SG is a sulfonamido group, it may be $—SO_2N^-COR_4M^+$, or $—NSO_2R_4M^+$ wherein $R_4$ is a substituted or unsubstituted aliphatic or cyclic group as defined from $R_1$. $R_1$ and $R_4$ can be the same or different group. More preferably, SG is a carboxy or sulfo group (or salts thereof), particularly when both m and n are 1.

$M^+$ is a suitable cation such as hydrogen or a metal cation (preferably an alkali metal cation) or an ammonium ion. When $M^+$ is a hydrogen atom, the resulting free acid can be easily solubilized by neutralization with a suitable base such as for example, potassium hydroxide or sodium bicarbonate.

In preferred embodiments, when m and n are both 0, SG is carboxy (or a salt thereof), sulfo (or a salt thereof), phospho (or a salt thereof), $—SO_2N^-COR_4M^+$, or $—NSO_2R_4M^+$ wherein $M^+$ is as defined above.

Additionally, when m and n are both 1, SG is carboxy (or a salt thereof), sulfo (or a salt thereof), phospho (or a salt thereof), or $—SO_2N^-COR_4M^+$ wherein $M^+$ is as defined above.

Moreover, when m is 1 and n is 0, SG is carboxy (or a salt thereof), sulfo (or a salt thereof), phospho (or a salt thereof), or $—N^-SO_2R_4M^+$ wherein $M^+$ is as defined above.

Representative antifoggants useful within the practice of this invention include the following compounds:

A-1

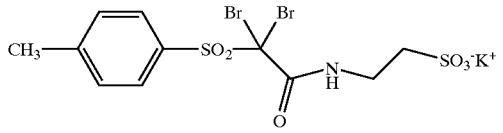

A-2

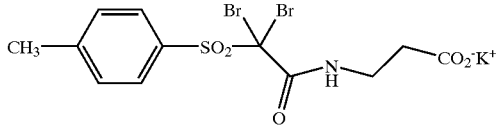

A-3

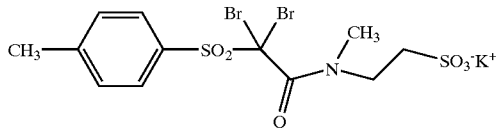

-continued
A-4
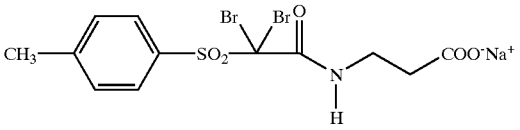
A-5
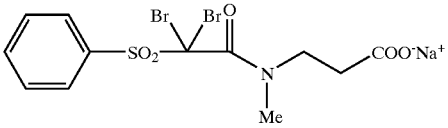
A-6
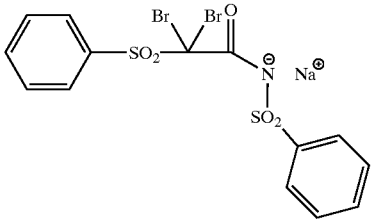
A-7
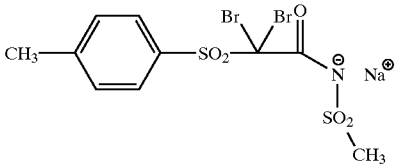
A-8
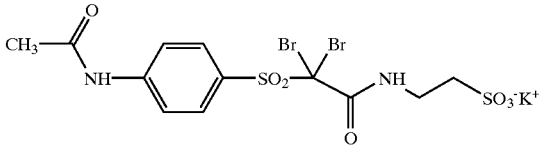
A-9
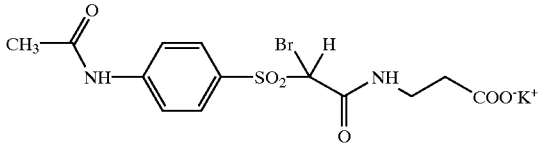
A-10
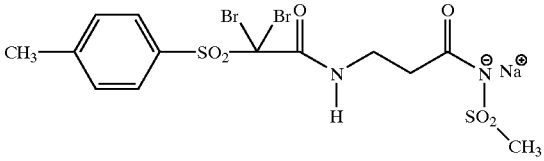
A-11
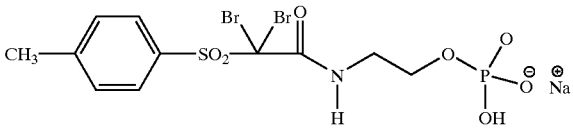
A-12
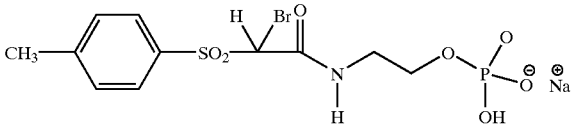
-continued
A-13
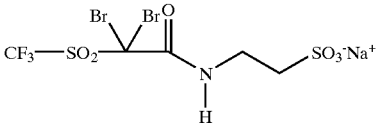
A-14
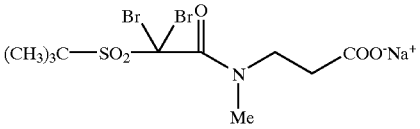
A-15
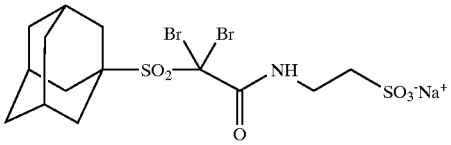
A-16
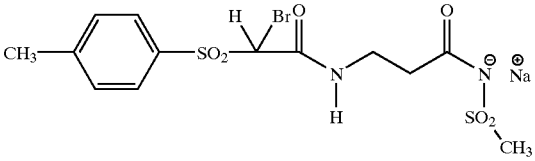
A-17
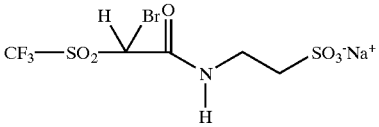
A-18
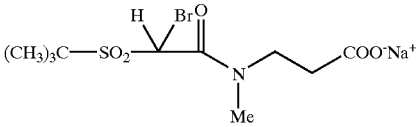
A-19
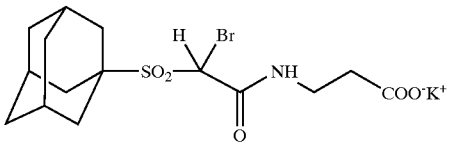
A-20
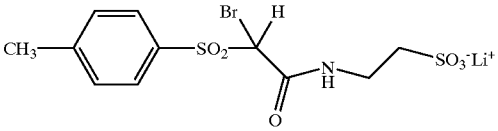
A-21
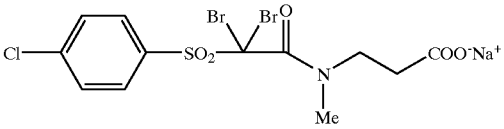
A-22
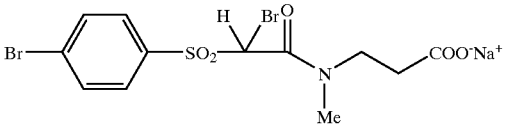

-continued

A-23

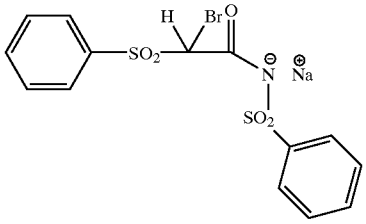

A-24

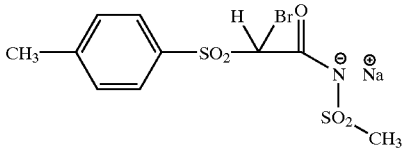

A-25

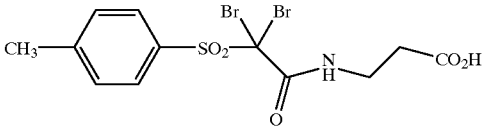

A-26

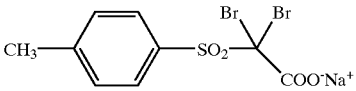

A-27

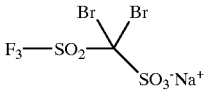

A-28

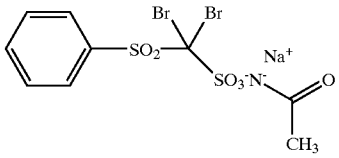

A-29

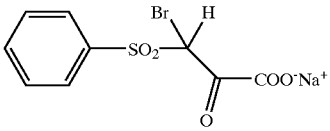

A-30

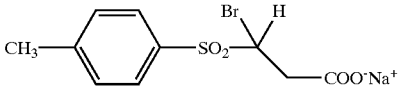

A-31

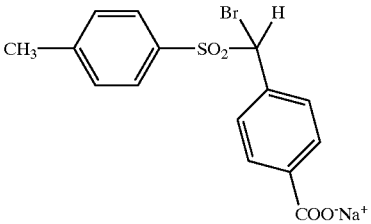

The compounds represented by Structure I can be prepared using starting materials and procedures that would be readily apparent to one skilled in the art. For example, compounds wherein m is 1 (and n is 0 or 1) can be prepared by reacting a salt of a sulfinic acid (such as p-toluenesulfinic acid, sodium salt) with a 2-bromomethylcarbonyl derivative, followed by bromination of the resulting sulfone using molecular bromine or another suitable brominating agent.

Instead of using the salt of a sulfinic acid, an aromatic or aliphatic thiol can be condensed with the 2-bromomethylcarbonyl derivative followed by oxidation of the thioether to a sulfone and then subsequent bromination.

Some 2-bromomethylcarbonyl derivatives can be prepared by reacting bromoacetylbromide with amines such as taurine as described in U.S. Pat. No. 5,091,298 (Parton et al.), with glycine as described by Hwang et al. in the *Journal of the Korean Society of Textile Engineers and Chemists,* p 13, December, 1981, or with methanesulfonamide as described in U.S. Pat. No. 5,620,989 (Harrison et al.).

Monobromination can be achieved by using only one equivalent of a source of bromine, using a less active brominating agent, or by adjusting reaction conditions as one skilled in the art would readily understand.

By "water-soluble" or "water-dispersible" in defining the antifoggants is meant that the compounds are more soluble or dispersible in water than polar organic solvents generally used for coating photothermographic formulations (such as methyl ethyl ketone and acetone).

The antifoggants can be used individually or in combination in the photothermographic materials of this invention. Generally, they are present in an amount of at least 0.0001 mol/mol of total silver. Preferably, they are present in an amount of from about 0.001 to about 0.1 mol/mol of total silver.

Preferably, the antifoggants are included in the one or more photothermographic emulsion layers, but during manufacture, they can also be incorporated into interlayers, underlayers, and protective topcoat layers on the frontside of the support. If they are placed in a non-emulsion layer, they tend to migrate into the emulsion layer(s) where they become effective in reducing $D_{min}$.

Other Addenda

The photothermographic materials of the present invention can also contain other additives such as shelf-life stabilizers, toners, additional antifoggants besides those described above, contrast enhancers, development accelerators, acutance dyes, post-processing stabilizers or stabilizer precursors, and other image-modifying agents as would be readily apparent to one skilled in the art.

The photothermographic materials can be further protected against the production of fog and can be stabilized against loss of sensitivity during storage. It may be advantageous to add mercury (II) salts to the emulsion layer(s) as an antifoggant. Preferred mercury (II) salts for this purpose are mercuric acetate and mercuric bromide. Other useful mercury salts include those described in U.S. Pat. No. 2,728,663 (Allen).

Other suitable optional antifoggants and stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum and gold salts as described in U.S. Pat. No. 2,566,263 (Trirelli) and U.S. Pat. No. 2,597,915 (Damshroder), and 2-(tribromomethylsulfonyl) quinoline compounds as described in U.S. Pat. No. 5,460,938 (Kirk et al.). Stabilizer precursor compounds capable of releasing stabilizers upon application of heat during development can also be used. Such precursor compounds are described in for example, U.S. Pat. No. 5,158,866 (Simpson et al.), U.S. Pat. No. 5,175,081 (Krepski et al.), U.S. Pat. No.

5,298,390 (Sakizadeh et al.), and U.S. Pat. No. 5,300,420 (Kenney et al.).

In addition, certain substituted-sulfonyl derivatives of benzotriazoles (for example alkylsulfonylbenzotriazoles and arylsulfonylbenzotriazoles) have been found to be useful stabilizing compounds (such as for post-processing print stabilizing), as described in U.S. Pat. No. 6,171,767 (Kong et al.).

Furthermore, other specific useful antifoggants/stabilizers are described in more detail in U.S. Pat. No. 6,083,681 (Lynch et al.), incorporated herein by reference.

Other optional antifoggants are hydrobromic acid salts of heterocyclic compounds (such as pyridinium hydrobromide perbromide) as described, for example, in U.S. Pat. No. 5,028,523 (Skoug), compounds having —$SO_2CBr_3$ groups as described for example in U.S. Pat. No. 5,594,143 (Kirk et al.) and U.S. Pat. No. 5,374,514 (Kirk et al.), benzoyl acid compounds as described, for example, in U.S. Pat. No. 4,784,939 (Pham), substituted propenenitrile compounds as described, for example, in U.S. Pat. No. 5,686,228 (Murray et al.), silyl blocked compounds as described, for example, in U.S. Pat. No. 5,358,843 (Sakizadeh et al.), vinyl sulfones as described, for example, in EP-A-0 600 589 (Philip, Jr. et al.) and EP-A-0 600 586 (Philip, Jr. et al.), and tribromomethylketones as described, for example, in EP-A-0 600 587 (Oliff et al.).

The use of "toners" or derivatives thereof that improve the image is highly desirable. Preferably, if used, a toner can be present in an amount of about 0.01% by weight to about 10%, and more preferably about 0.1% by weight to about 10% by weight, based on the total dry weight of the layer in which it is included. Toners may be incorporated in the photothermographic emulsion layer or in an adjacent layer. Toners are well known materials in the photothermographic art, as shown in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599, 647 (Defieuw et al.), and GB 1,439,478 (Agfa-Gevaert).

Examples of toners include, but are not limited to, phthalimide and N-hydroxyphthalimide, cyclic imides (such as succinimide), pyrazoline-5-ones, quinazolinone, 1-phenylurazole, 3-phenyl-2-pyrazoline-5-one, and 2,4-thiazolidinedione, naphthalimides (such as N-hydroxy-1,8-naphthalimide), cobalt complexes [such as hexaaminecobalt (3+) trifluoroacetate], mercaptans (such as 3-mercapto-1,2,4-triazole, 2,4-dimercaptopyrimidine, 3-mercapto-4,5-diphenyl-1,2,4-triazole and 2,5-dimercapto-1,3,4-thiadiazole), N-(aminomethyl)aryldicarboximides [such as (N,N-dimethylaminomethyl)phthalimide, and N-(dimethylaminomethyl)naphthalene-2,3-dicarboximide, a combination of blocked pyrazoles, isothiuronium derivatives, and certain photobleach agents [such as a combination of N,N'-hexamethylene-bis(1-carbamoyl-3,5-dimethyl-pyrazole), 1,8-(3,6-diazaoctane)bis(isothiuronium)trifluoroacetate, and 2-(tribromomethylsulfonyl benzothiazole)], merocyanine dyes {such as 3-ethyl-5-[(3-ethyl-2-benzothiazolinylidene)-1-methyl-ethylidene]-2-thio-2,4-o-azolidinedione}, phthalazine and derivatives thereof [such as those described in U.S. Pat. No. 6,146,822 (Asanuma et al.)], phthalazinone and phthalazinone derivatives, or metal salts or these derivatives [such as 4-(1-naphthyl)phthalazinone, 6-chlorophthalazinone, 5,7-dimethoxyphthalazinone, and 2,3-dihydro-1,4-phthalazinedione], a combination of phthalazine (or derivative thereof) plus one or more phthalic acid derivatives (such as phthalic acid, 4-methylphthalic acid, 4-nitrophthalic acid, and tetrachlorophthalic anhydride), quinazolinediones, benzoxazine or naphthoxazine derivatives, rhodium complexes functioning not only as tone modifiers but also as sources of halide ion for silver halide formation in situ [such as ammonium hexachlororhodate (III), rhodium bromide, rhodium nitrate, and potassium hexachlororhodate (III)], inorganic peroxides and persulfates (such as ammonium peroxydisulfate and hydrogen peroxide), benzoxazine-2,4-diones (such as 1,3-benzoxazine-2,4-dione, 8-methyl-1,3-benzoxazine-2,4-dione and 6-nitro-1,3-benzoxazine-2,4-dione), pyrimidines and asym-triazines (such as 2,4-dihydroxypyrimidine, 2-hydroxy-4-aminopyrimidine and azauracil) and tetraazapentalene derivatives [such as 3,6-dimercapto-1,4-diphenyl-1H,4H-2,3a,5,6a-tetraazapentalene and 1,4-di-(o-chlorophenyl)-3,6-dimercapto-1H,4H-2,3a,5,6a-tetraazapentalene].

Phthalazine and phthalazine derivatives [such as those described in U.S. Pat. No. 6,146,822 (noted above), incorporated herein by reference] are particularly useful toners.

Binders

The photosensitive silver halide, the non-photosensitive source of reducible silver ions, the reducing agent composition, and any other additives used in the present invention are generally used in one or more binders that are predominantly hydrophilic in nature. Mixtures of such binders can also be used. By "predominantly" is meant that at least 50% by weight of the total binders are hydrophilic in nature. The rest may include one or more binders that are hydrophobic in nature.

The photothermographic materials of the present invention comprise one or more hydrophilic binders in the various layers (especially emulsion layers) that may include, but are not limited to, gelatin and gelatin derivatives (hardened or unhardened), cellulosic materials such as cellulose acetate, cellulose acetate butyrate, polysaccharides (such as dextrin), poly(silicic acid), hydroxymethyl cellulose, acrylamide/methacrylamide polymers, acrylic/methacrylic polymers polyvinyl pyrrolidones, polyvinyl acetates, polyvinyl alcohols, and polysaccharides (such as dextrans and starch ethers). Gelatins and poly(vinyl alcohol) are most preferred.

Examples of typical hydrophobic binders include, but are not limited to, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable binders are polyvinyl butyral resins that are available as BUTVAR® B79 (Solutia, Inc.) and Pioloform BS-18 or Pioloform BL-16 (Wacker Chemical Company).

Hardeners for various binders may be present if desired. Useful hardeners are well known and include diisocyanate compounds as described for example in EP-0 600 586B1 and vinyl sulfone compounds as described in EP-0 600 589B1.

Where the proportions and activities of the photothermographic materials require a particular developing time and temperature, the binder(s) should be able to withstand those conditions. Generally, it is preferred that the binder be resistant to decomposition or loss of structural integrity at 120° C. for 60 seconds. It is more preferred that it not decompose or lose its structural integrity at 177° C. for 60 seconds.

The polymer binder(s) is used in an amount sufficient to carry the components dispersed therein. The effective range can be appropriately determined by one skilled in the art. Preferably, a binder is used at a level of about 10% by weight to about 90% by weight, and more preferably at a level of about 20% by weight to about 70% by weight, based on the total dry weight of the layer in which it is included.

Support Materials

The photothermographic materials can be prepared using a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins (such as polyethylene and polypropylene), polycarbonates, and polystyrenes (and polymers of styrene derivatives). Preferred supports are composed of polymers having good heat stability, such as polyesters and polycarbonates. Polyethylene terephthalate film is the most preferred support. Various support materials are described, for example, in *Research Disclosure,* August 1979, item 18431. A method of making dimensionally stable polyester films is described in *Research Disclosure,* September, 1999, item 42536.

Opaque supports can also be used such as dyed polymeric films and resin-coated papers that are stable to high temperatures.

Support materials can contain various colorants, pigments, antihalation or acutance dyes if desired. Support materials may be treated using conventional procedures (such as corona discharge) to improve adhesion of overlying layers, or subbing or other adhesion-promoting layers can be used. Useful subbing layer formulations include those conventionally used for photographic materials such as vinylidene halide polymers.

Photothermographic Formulations

The formulation for the photothermographic emulsion layer(s) can be prepared by dissolving and dispersing the binder(s), the photothermographic emulsion (that is, the photosensitive silver halides and the non-photosensitive source of reducible silver ions), the reducing composition, the water-soluble antifoggant(s), and optional addenda in an aqueous solvent that includes water and possibly minor amounts (less than 50 volume %) of a water-miscible solvent (such as acetone or a lower alcohol) to provide aqueous-based coating formulations.

Photothermographic materials can also contain plasticizers and lubricants such as polyalcohols and diols of the type described in U.S. Pat. No. 2,960,404 (Milton et al.), fatty acids or esters such as those described in U.S. Pat. No. 2,588,765 (Robijns) and U.S. Pat. 3,121,060 (Duane), and silicone resins such as those described in GB 955,061 (DuPont). The materials can also contain matting agents such as starch, titanium dioxide, zinc oxide, silica, and polymeric beads, including beads of the type described in U.S. Pat. No. 2,992,101 (Jelley et al.) and U.S. Pat. No. 2,701,245 (Lynn). Polymeric fluorinated surfactants may also be useful in one or more layers of the imaging materials for various purposes, such as improving coatability and optical density uniformity as described in U.S. Pat. No. 5,468,603 (Kub).

EP-A-0 792 476 (Geisler et al.) describes various means of modifying photothermographic materials to reduce what is known as the "woodgrain" effect, or uneven optical density. This effect can be reduced or eliminated by several means, including treatment of the support, adding matting agents to the topcoat, using acutance dyes in certain layers, or other procedures described in the noted publication.

The photothermographic materials of this invention can include antistatic or conducting layers. Such layers may contain soluble salts (for example, chlorides or nitrates), evaporated metal layers, or ionic polymers such as those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy), electroconductive underlayers such as those described in U.S. Pat. No. 5,310,640 (Markin et al.), electronically-conductive metal antimonate particles such as those described in U.S. Pat. No. 5,368,995 (Christian et al.), and electrically-conductive metal-containing particles dispersed in a polymeric binder such as those described in EP-A-0 678 776 (Melpolder et al.). Other antistatic agents are well known in the art.

The photothermographic materials can be constructed of one or more layers on a support. Single layer materials should contain the photosensitive silver halide, the non-photosensitive source of reducible silver ions, the reducing composition, the binder, as well as optional materials such as toners, acutance dyes, coating aids and other adjuvants.

Two-layer constructions comprising a single imaging layer coating containing all the ingredients and a protective topcoat are generally found in the photothermographic materials. However, two-layer constructions containing photosensitive silver halide and non-photosensitive source of reducible silver ions in an emulsion layer (usually the layer adjacent to the support) and the reducing composition and other ingredients in a different layer or distributed between both layers are also envisioned. Generally, the multiple layers are coated out of an aqueous solvent as described above. Thus, where the photothermographic materials comprise protective overcoat and/or antihalation layers, they are generally coated out of an aqueous solvent as aqueous-based formulations.

Layers to promote adhesion of one layer to another are also known, as described for example, in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described for example, in U.S. Pat. No. 5,928,857 (Geisler et al.).

Protective overcoats or topcoats can also be present over the one or more photothermographic emulsion layers. The overcoats are generally transparent are composed of one or more film-forming hydrophilic binders such as poly(vinyl alcohol), gelatin (and gelatin derivatives), and poly(silicic acid). A combination of poly(vinyl alcohol) and poly(silicic acid) is particularly useful. Such layers can further comprise matte particles, plasticizers, and other additives readily apparent to one skilled in the art.

Various components necessary for providing the desired image can also be incorporated into the protective overcoat as long as they can migrate into lower layers for appropriate chemical reactions or interactions. For example, the antifoggants represented by Structure I and various reducing agents can be incorporated into the protective overcoat.

The protective layer can also be a backing layer (such as an antihalation layer) that is on the backside of the support.

Preferred photothermographic materials of this invention comprise a protective overcoat on the imaging side, an antihalation layer on the backside, or both.

Photothermographic emulsions of this invention can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.), and GB 837,095 (Ilford), all incorporated herein by reference. A typical coating gap for the emulsion layer can be from about 10 to about 750 $\mu$m, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

Mottle and other surface anomalies can be reduced in the materials of this invention by incorporation of a fluorinated polymer as described for example, in U.S. Pat. No. 5,532,121 (Yonkoski et al.) or by using particular drying techniques as described, for example, in U.S. Pat. No. 5,621,983 (Ludemann et al.).

Preferably, two or more layers are applied to a film support using slide coating. The first layer can be coated on top of the second layer while the second layer is still wet. The first and second fluids used to coat these layers can be the same or different organic solvents (or organic solvent mixtures).

While the first and second layers can be coated on one side of the film support, the manufacturing method can also include forming on the opposing or backside of said polymeric support, one or more additional layers, including an antihalation layer, an antistatic layer, or a layer containing a matting agent (such as silica), or a combination of such layers. It is also contemplated that the photothermographic materials of this invention can include emulsion layers on both sides of the support.

To promote image sharpness, photothermographic materials can contain one or more layers containing acutance and/or antihalation dyes. These dyes are chosen to have absorption close to the exposure wavelength and are designed to absorb scattered light. One or more antihalation dyes may be incorporated into one or more antihalation layers according to known techniques, as an antihalation backing layer, as an antihalation underlayer, or as an antihalation overcoat. Additionally, one or more acutance dyes may be incorporated into one or more frontside layers such as the photothermographic emulsion layer, primer layer, underlayer, or topcoat layer according to known techniques. It is preferred that the photothermographic materials contain an antihalation coating on the support opposite to the side on which the emulsion and topcoat layers are coated.

Dyes particularly useful as antihalation and acutance dyes include dihydroperimidine squaraine dyes having the nucleus represented by the following general structure:

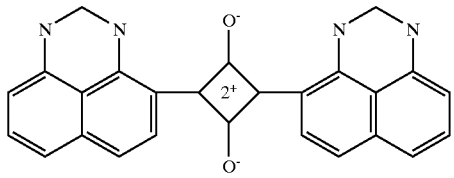

Details of such dyes having the dihydropyrimidine squaraine nucleus and methods of their preparation can be found in U.S. Pat. No. 6,063,560 (Suzuki et al.) and U.S. Pat. No. 5,380,635 (Gomez et al.), both incorporated herein by reference. These dyes can also be used as acutance dyes in frontside layers of the materials of this invention. One particularly useful dihydropyrimidine squaraine dye is cyclobutenediylium, 1,3-bis[2,3-dihydro-2,2-bis[[1-oxohexyl)oxy]methyl]-1H-pyrimidin-4-yl]-2,4-dihydroxy-, bis(inner salt).

Dyes particularly useful as antihalation dyes in a backside layer of the photothermographic material also include indolenine cyanine dyes having the nucleus represented by the following general structure:

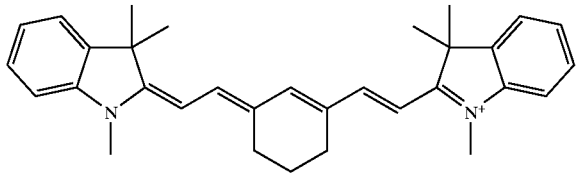

Details of such antihalation dyes having the indolenine cyanine nucleus and methods of their preparation can be found in EP-A-0 342 810 (Leichter), incorporated herein by reference. One particularly useful cyanine dye, compound (6) described therein, is 3H-Indolium, 2-[2-[2-chloro-3-[(1,3-dihydro-1,3,3-trimethyl-2H-indol-2-ylidene)ethylidene]-5-methyl-1-cyclohexen-1-yl]ethenyl]-1,3,3-trimethyl-, perchlorate.

Imaging/Development

While the photothermographic materials can be imaged in any suitable manner consistent with the type of material using any suitable imaging source (typically some type of radiation or electronic signal), the following discussion will be directed to the preferred imaging means. Generally, the materials are sensitive to radiation in the range of from about 190 to about 850 nm (preferably from about 400 to about 850 nm).

Imaging can be achieved by exposing the photothermographic materials to a suitable source of radiation to which they are sensitive, including ultraviolet light, visible light, near infrared radiation and infrared radiation to provide a latent image. Suitable exposure means are well known and include laser diodes that emit radiation in the desired region, photodiodes and others described in the art, including *Research Disclosure,* September 1996, item 38957, (such as sunlight, xenon lamps and fluorescent lamps). Particularly useful exposure means uses laser diodes, including laser diodes that are modulated to increase imaging efficiency using what is known as multilongitudinal exposure techniques as described in U.S. Pat. No. 5,780,207 (Mohapatra et al.). Other exposure techniques are described in U.S. Pat. No. 5,493,327 (McCallum et al.).

For using the photothermographic materials, development conditions will vary, depending on the construction used but will typically involve heating the imagewise exposed material at a suitably elevated temperature. Thus, the latent image can be developed by heating the exposed material at a moderately elevated temperature of, for example, from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means such as a hot plate, a steam iron, a hot roller or a heating bath.

In some methods, the development is carried out in two steps. Thermal development takes place at a higher temperature for a shorter time (for example, at about 150° C. for up to 10 seconds), followed by thermal diffusion at a lower temperature (for example, at about 80° C.) in the presence of a transfer solvent.

Methods and Materials for the Examples

All materials used in the following examples are readily available from standard commercial sources or prepared using known procedures and starting materials unless otherwise specified. All percentages are by weight unless otherwise indicated.

IR-1

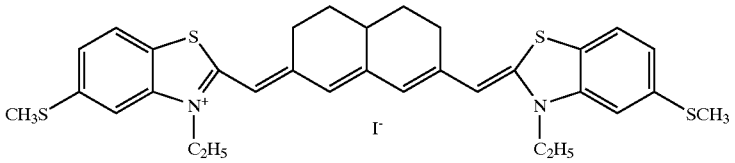

Deaggregate Compound A is benzenesulfonic acid, 2,2'-(1,2-ethenediyl)bis(5-(4-chloro-6-((2-chlorophenyl)amino)-1,3,5-triazin-2-yl)amino)-disodium salt, can be obtained using conventional synthetic methods known in the literature, and has the following structure:

Compound A

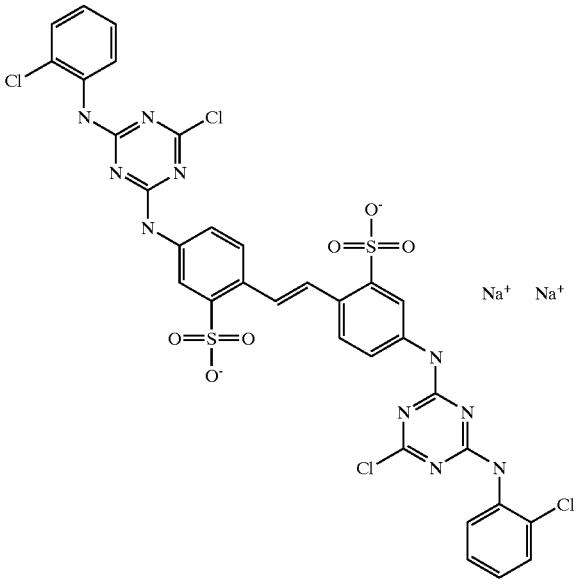

Antifoggant Compound B is 2-bromo-2-(4-methylphenylsulfonyl)acetamide, can be obtained using the teaching provided in U.S. Pat. No. 3,955,982 (Van Allan), and has the following structure:

Compound B

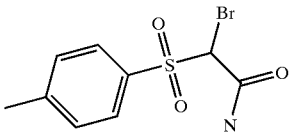

Antifoggant Compound C is 2,2'dibromo-2-phenylsulfonyl-N-(2-ethyl)acetamide, can be prepared by a skilled artisan using known starting materials and common procedures (similarly to Compound B), and has the following structure:

Compound C

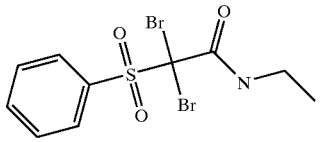

Antifoggant Compound D is 2,2'-dibromo-2-(4-methylphenylsulfonyl)acetamide, can be prepared by a skilled artisan using known starting materials and common procedures (similarly to Compound B), and has the following structure:

Compound D

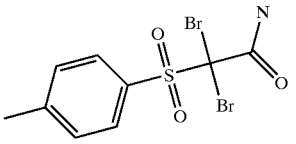

Antifoggant Compound E is 2-(tribromomethylsulfonyl) quinoline, can be obtained from Sumitomo Seika Chemicals Co. Ltd., and has the following structure:

Compound E

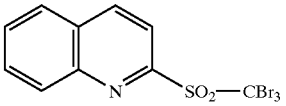

Inventive antifoggant A-1 is 2,2'-dibromo-(4-methylphenyl)sulfonyl-N-(2-sulfoethyl)acetamide potassium salt, and has the structure shown above. Compound A-1 was prepared as follows:

To a 5-liter flask equipped with a mechanical stirrer and reflux condenser was added p-toluenesulfinic acid, lithium salt (308.57 g), N-(2-sulfoethyl)-2-bromoacetamide, lithium salt (527.39 g), water (180 ml), and ethyl alcohol (3380 ml). The resulting suspension was heated to reflux. After about an hour of reflux, nearly all of the reactants had dissolved. Reflux was continued another four hours, and the solution was filtered hot through a Celite pad to remove some haziness. The solution was cooled overnight to room temperature. The solid that formed was collected and washed with 1 liter of 95% ethyl alcohol/water. The white solid was air dried and then dried at high vacuum, providing 553.88 g (89% yield) of 2-(4-methylphenyl)sulfonyl-N-(2-sulfoethyl) acetamide, lithium salt (Intermediate 1). HPLC analysis showed no detectable impurities. Ion chromatography indicated 0.035 weight % bromide and 1.8 weight % lithium. The material exhibited an acceptable proton spectrum.

To glacial acetic acid (660 ml) was added Intermediate 1 (98.19 g), and 1,3-dibromo-5,5-dimethylhydantoin (42.89 g). The resulting suspension was heated to reflux where solution occurred. After about 3–5 minutes at reflux, the slight bromine color was discharged, and reflux was continued to another 15 minutes. Analysis of the reaction mixture by HPLC indicated conversion to one main product. After cooling to near room temperature, most of the acetic acid was removed on the rotary film evaporator using a water aspirator (water bath temperature at 40° C.). The residue was diluted with 2500 ml of ethyl alcohol. Complete solution occurred after stirring the suspension for one hour at room temperature. To this stirring solution at room temperature was added dropwise a solution of potassium acetate (58.88 g) dissolved in ethyl alcohol (500 ml). A white solid formed immediately. Upon complete addition of the potassium acetate solution, the suspension was stirred at room temperature for 90 minutes, and the desired antifoggant A-1, 2,2-dibromo-2-(4-methylphenyl)sulfonyl-N-(2-sulfoethyl)acetamide, potassium salt, was collected by filtration and washed with ethyl alcohol. The solid was then dried under high vacuum at 40° C. The yield of crude antifoggant A-1, which had a slight odor of acetic acid, was 145.22 g (94%).

Two separate synthetic batches of A-1 were made, combined, and recrystallized by dissolving 182.33 g of product in a mixture of water (85 ml) and ethyl alcohol (600 ml) while boiled, filtered hot, and adding about 7 ml water upon cooling to prevent oiling. After letting the solution stand overnight at room temperature, the desired antifoggant product was collected and washed with about 300 ml (10:1 v/v) ethyl alcohol/water mixture. The product was then air-dried and then dried under high vacuum at 40° C., providing 159.87 g of desired product. HPLC analysis indicated an assay of 99.2% of the desired component. The product exhibited the expected proton NMR spectrum and mass spectrum consistent with the A-1 structure shown above.

Inventive antifoggant A-2 is 2,2'-dibromo-(4-methylphenyl)sulfonyl-N-(2-carboxyethyl)acetamide, potassium salt, and has the structure noted above. Compound A-2 was prepared similarly to Compound A-1 except that the N-(2-sulfoethyl)-2-bromoacetamide, lithium salt is replaced by the HCl salt of the ethyl ester of β-alanine. The resulting substituted bromoacetamide is reacted as above with the sodium salt of toluenesufinic acid followed by alkaline hydrolysis of the ester and subsequent reaction with bromine to form A-2.

Inventive antifoggant A-7 was prepared similarly to Compound A-1 except that N-bromoacetylmethanesulfonamide was reacted with the sodium salt of toluenesufinic acid, followed by bromination with molecular bromine.

Inventive antifoggant A-20 is 2-bromo-2-(4-methylphenyl)sulfonyl-N-(2-sulfoethyl)acetamide lithium salt, and has the structure drawn above. Compound A-20 was prepared as follows:

To glacial acetic acid (125 ml) was added Intermediate 1 (18.66 g), and the suspension was heated in an oil bath at a temperature of 52° C. To the stirred suspension was added drop-wise over a 5-hour period, a solution of bromine (14.77 g) dissolved in glacial acetic acid (15 ml). Upon complete addition, the temperature of the oil bath was maintained at 52° C. for 75 min. and then the heat was removed. Upon standing at room temperature, solid formed. The product was collected and washed sequentially with glacial acetic acid and acetonitrile and dried in a vacuum oven, obtaining 20.21 g of a white solid. The material was further purified by dissolving the solid (17.30 g) at boiling in 200 ml of acetonitrile containing 4 ml of water, and then cooling to room temperature. Examination by HPLC indicated greater than 99% of one component that analyzed by both mass spectroscopy and NMR for A-20, 2-bromo-2-(4-methylphenyl)sulfonyl-N-(2-sulfoethyl)acetamide lithium salt.

Reducing agent (developer) DEV-1 has the following structure:

DEV-1

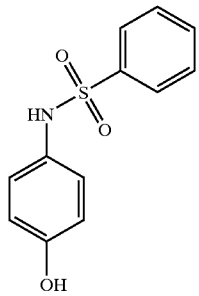

Reducing agent (developer) DEV-2 has the following structure:

DEV-2

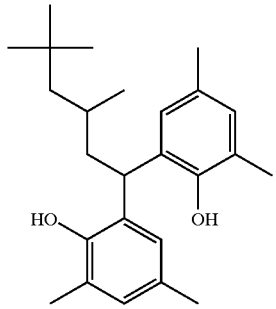

Densitometry measurements were made on a custom built computer-scanned densitometer using a filter appropriate to the sensitivity of the photothermographic material and are believed to be comparable to measurements from commercially available densitometers. $D_{min}$ is the density of the non-exposed areas after development and it is the average of the eight lowest density values. $D_{max}$ is maximum density. The ratio of maximum density to minimum density gives a measure of Development Efficiency ("DE"), and a high value is desirable, as is low $D_{min}$.

The following examples are representative of the present invention and its practice and are not meant to be limiting in any manner.

EXAMPLES 1–3

A) Preparation of Microparticulate Silver Behenate

A reactor was initially charged with demineralized water (1060 kg), methanol (96 kg), and behenic acid [54.4 kg, nominally 90% behenic acid (Unichema) recrystallized from isopropanol]. The reactor contents were then heated to 70° C. and a 10.85% w/w KOH solution (76.4 kg) were added to the reactor. The reactor contents were then heated to 85° C. and held for 30 min. The reactor contents were then cooled to 70° C. and a silver nitrate solution consisting of silver nitrate (24.74 kg) dissolved in demineralized water (140 kg) was added to the reactor at a constant rate during 30 min. The reactor contents were then cooled to 20° C. and demineralized water (1440 kg) were added to the reactor. The reaction mixture was stirred for 10 minutes and after 60 minutes, the mixture had separated into two layers. The bottom layer consisted of clear liquors while the product had floated into the top layer. The bottom layer was discarded, and the wash procedure was repeated.

The remaining silver behenate suspension was deliquored using a centrifugal basket filter that was lined with a canvas filter medium and then washed with demineralized water. After deliquoring, the yield was a 40% w/w microparticulate silver behenate "wet cake".

B) Preparation of Aqueous Microparticulate Silver Behenate Dispersion (MSBH)

To a container were added 35% solids microparticulate silver behenate (AgBeh) "wet cake" (600 g) described above and a 6.2% aqueous solution (271 g) of polyvinyl alcohol [PVA, ELVANOL™ 52–22 86–89% hydrolyzed (Dupont)]. The resulting mixture was blended for 2 hours at high-speed (4200 rpm) using a Cowles-type saw tooth impeller (40-mm diameter) at 21° C. to make the dispersion MSBH.

C) AgBrI Imaging Emulsion

A silver bromoiodide emulsion was prepared using conventional precipitation techniques. The resulting AgBrI emulsion comprised 3 mol % iodide (based on total silver in the silver halide) cubic grains having a mean edge length of 57 nm, and gelatin (20 g/mol silver in the silver halide).

D) Preparation of Comparative Photothermographic Material 1

A photothermographic imaging composition was prepared by mixing a 7.0% aqueous solution (143 g) of polyvinyl alcohol [PVA, ELVANOL 52–22 86–89% hydrolyzed (DuPont)] with the dispersion MSBH (104 g). Succinimide (3 g) and an aqueous solution (2 g) of sodium iodide (185 g/l) were then added. The resulting mixture was stirred overnight. Next were added 23 g of a well-stirred mixture containing the AgBrI emulsion (13 g) noted above, Compound A (26 mg), and sensitizing dye IR-1 (8 mg). To the resulting mixture was added a solid-particle dispersion (43 g) of reducing agent (DEV-1) that had been prepared by milling DEV-1 (114 g), sodium dodecyl sulfate (4.6 g), and polyvinylpyrrolidone (9.1 g) in water with $ZrO_2$ beads for 6 days.

The above prepared mixture was coated onto a clear gelatin-subbed, 0.178-mm thick poly(ethylene terephthalate) support to give a wet coverage of 86.95 g/m$^2$ to provide a photothermographic material. On top of this photothermographic imaging layer was added a protective topcoat layer containing PVA, sulfo-1,4-bis(2-ethylhexyl) ester butanedioic acid, sodium salt, ZONYL FSN 100 nonionic surfactant, and p-toluenesulfonic acid (to adjust pH to 3) all in conventional amounts.

E) Exposure and Development

Coatings were exposed with an 810 nm diode laser through a 21-step neutral density tablet and then heat processed at 122° C. for 15 seconds to provide a silver image.

F) Preparation of Additional Photothermographic Materials

Additional imaging compositions and photothermographic materials were prepared following the procedure described above except that Comparative and Inventive antifoggants were added prior to addition of the AgBrI imaging emulsion. Comparative Compound B was added as a solid-particle dispersion prepared by milling in the presence of TRITON-X 200 anionic surfactant using conventional milling techniques. Comparative Compounds C and D were added from methanol solution. Inventive antifoggant compound A-1 was added from water solution.

After preparation, exposure, and development of the photothermographic materials, minimum ($D_{min}$) and maximum ($D_{max}$) densities were measured. TABLE I below shows the sensitometric results for the various photothermographic materials.

TABLE I

| Material | Antifoggant Compound | Antifoggant amount (mmol/total mol Ag) | $D_{min}$ | "DE" |
|---|---|---|---|---|
| Comparative 1 | 0 | 0 | 0.78 | 4.6 |
| Comparative 2 | Compound B | 80 | 0.20 | 14.7 |
| Comparative 3 | | 120 | 0.18 | 16.1 |
| Comparative 4 | Compound C | 2 | 0.18 | 18.4 |
| Comparative 5 | | 4 | 0.15 | 19 |
| Comparative 6 | | 8 | 0.12 | 20.9 |
| Comparative 7 | Compound D | 2 | 0.31 | 10.7 |
| Comparative 8 | | 4 | 0.20 | 15 |
| Comparative 9 | | 8 | 0.18 | 14.6 |
| Example 1 | A-1 | 4 | 0.17 | 19.5 |
| Example 2 | | 8 | 0.14 | 20.7 |
| Example 3 | | 16 | 0.10 | 26.3 |

The results in TABLE I show that the inventive antifoggant in the photothermographic materials of this invention favorably reduced minimum density while also greatly increasing the development efficiency. The inventive antifoggant was also advantageously added from water solution in this aqueous construction, while the comparative compounds required organic solvent or dispersion preparation. The appropriate level of inventive compound A-1 (or any other compound within the scope of the present invention) to give provide desired minimum density and development efficiency can be readily found by a worker who is skilled in the art with routine experimentation.

EXAMPLES 4–5

Comparative photothermographic materials 10–12 and inventive Example 4 photothermographic material were prepared following the procedure described in Examples 1–3 above except that comparative and inventive antifoggants were added only prior to addition of the AgBrI imaging emulsion, and the protective overcoat was adjusted to pH 6. Comparative Compound E was added as a solid-particle dispersion prepared by milling in the presence of TRITON-X 200 anionic surfactant using conventional milling techniques.

Comparative photothermographic materials 13–15 and inventive Example 5 photothermographic material were prepared following the procedure described in Examples 1–3 except that the comparative and inventive antifoggant compounds were added only to the protective overcoat formulation that was adjusted to pH 6. The antifoggant compounds were allowed to migrate into the imaging layers of the respective photothermographic materials.

TABLE II below shows the sensitometric results after exposure and development of the photothermographic materials.

TABLE II

| Material | Antifoggant Compound | Antifoggant amount (mmol/total mol Ag) | $D_{min}$ | "DE" |
|---|---|---|---|---|
| In Imaging Layer | | | | |
| Comparative 10 | 0 | 0 | 0.50 | 6.3 |
| Comparative 11 | Compound B | 0.85 | 0.38 | 7.9 |
| Comparative 12 | Compound E | 0.13 | 0.17 | 11.8 |
| Example 4 | A-1 | 0.26 | 0.19 | 13.8 |
| In Protective Topcoat Layer | | | | |
| Comparative 13 | 0 | 0 | 0.62 | 5.7 |
| Comparative 14 | Compound B | 0.85 | 0.62 | 5.5 |
| Comparative 15 | CompoundE | 0.13 | 0.79 | 4.4 |
| Example 5 | A-1 | 0.26 | 0.20 | 16.4 |

The results in TABLE II show that the inventive compound A-b 1performs equivalently to comparative compound E that is described in U.S. Pat. No. 5,460,938 (Kirk) when added directly to the imaging layer formulation but it provides greater benefit when it was added to the protective topcoat formulation. This provides flexibility in formulating and manufacturing aqueous-based photothermographic materials.

EXAMPLE 6

A) Preparation of Nanoparticulate Silver Behenate

A reactor was charged with water, a 10% dodecylthiopolyacrylamide surfactant solution (72 g), and behenic acid (46.6 g). The contents were stirred at 150 rpm and heated to 70° C., at which time aqueous potassium hydroxide (65.1 g, 10.85% solution) was added to the reactor. The mixture was heated to 80° C. and held for 30 minutes until a hazy solution was achieved. The mixture was then cooled to the desired reaction temperature at which time aqueous silver nitrate (166.7 g of 12.77% solution) was fed into the reactor in a controlled addition. After the addition, the resulting nanoparticulate silver behenate was held at the reaction temperature for 30 minutes, cooled to room temperature, and decanted. A silver behenate dispersion with a median particle size of 140 nm was obtained.

B) Purifying and Concentrating Nanoparticulate Silver Behenate Dispersion (NPSB)

The 3% solids nanoparticulate silver behenate dispersion (12 kg) was loaded into a diafiltration/ultrafiltration apparatus (with an Osmonics model 21-HZ20-S8J permeator membrane cartridge having an effective surface area of 0.34 $m^2$ and a nominal molecular weight cutoff of 50,000). The apparatus was run so that the pressure going into the permeator was 50 $lb/in^2$ (3.5 $kg/cm^2$) and the pressure downstream from the permeator was 20 $lb/in^2$ (1.4 $kg/cm^2$). The permeate was replaced with deionized water until 24 kg of permeate were removed from the dispersion. At this point the replacement water was turned off and the apparatus was run until the dispersion reached a concentration of 28% solids to provide a nanoparticulate silver behenate dispersion (NPSB).

C) AgBrI Imaging Emulsion

The same silver bromoiodide emulsion used for Examples 1–3 was used.

D) Preparation of Photothermographic Materials

An imaging composition was prepared by mixing an aqueous solution [194 g of 7.0% polyvinyl alcohol, PVA, ELVANOL 52–22 86–89% hydrolyzed (DuPont)] with Dispersion NPSB (102 g). Succinimide (3 g) was added and the mixture was stirred overnight. A well-stirred mixture (23 g) containing of the AgBrI emulsion (14 g), Compound A (26 mg), and sensitizing dye IR-1 (8 mg). To the resulting mixture was added a solid-particle dispersion (43 g) of reducing agent DEV-1 that had been prepared by milling DEV-1 (114 g), sodium dodecyl sulfate (4.6 g), and poly (vinyl pyrrolidone) (9.1 g) in water with $ZrO_2$ beads for 6 days.

The resulting imaging composition was then applied to a borax-containing support to provide a photothermographic imaging wet coverage of 86.95 $g/m^2$. To prepare the borax support, a solution containing 0.333 weight % Borax (Aldrich), 0.74% gelatin, 0.02% Saponin, and 98.91% water was coated onto a 7 mil (0.178 mm) thick gelatin-subbed poly(ethylene terephthalate) support. The borax solution was applied at a wet coverage of 16.14 $cm^3/m^2$, resulting in approximately 0.055 $g/m^2$ of Borax and 0.11 $g/m^2$ of gelatin after drying. On top of the imaging layer was added the same protective topcoat layer formulation described in Examples 1–3 above.

Additional photothermographic materials were prepared using the same procedure except that comparative and inventive antifoggant compounds were added prior to addition of the AgBrI imaging emulsion. Mercuric bromide and inventive compound A-1 were added from water.

E) Aging, Exposure, and Development

The effect of accelerated aging was accomplished by placing samples of the photothermographic materials in a heat-sealed, light-tight bag and holding them for 1 week at 50% relative humidity and 50° C. Exposure and development of those materials were then carried out as described in Examples 1–3. The sensitometric results obtained after accelerated aging were compared with the sensitometric results of samples of the same photothermographic materials that were exposed and developed without aging. The results are shown as Aging Fog in TABLE III wherein $D_{min}$ of the "fresh" samples was subtracted from the $D_{min}$ of the aged samples.

TABLE 3

| Material | Antifoggant Compound | Antifoggant Amount (mmol/total mol Ag) | $D_{min}$ | Aging Fog |
|---|---|---|---|---|
| Comparative 16 | 0 | 0 | 1.25 | 1.10 |
| Comparative 17 | $HgBr_2$ | 4.3 | 0.44 | 1.41 |
| Exarnple6 | A-1 | 16 | 0.28 | 0.31 |

The results in TABLE III show that the inventive antifoggant compound provides superior benefits (reduced change in $D_{min}$) and stabilizing action compared to mercuric bromide that is an environmentally undesirable antifoggant.

EXAMPLES 7–9

A) Nanoparticulate Silver Behenate

The same silver behenate (NPSB) used for Example 6 was used.

B) AgBrI Imaging Emulsion

The same silver bromoiodide emulsion used for Examples 1–6 was used.

C) Preparation of Photothermographic Materials

An imaging composition was prepared by mixing an aqueous solution [166 g of 6.3% polyvinyl alcohol, PVA, ELVANOL 52–22 86–89% hydrolyzed (DuPont)] with Dispersion NPSB (114 g) and adjusting to pH 6.5 at 40° C. A solid-particle dispersion (17% by weight) of Compound B (11 g) was added and held for 20 minutes. Succinimide (3 g) and an aqueous solution (6 g) of sodium iodide (50 g/l) were added, held for 60 minutes at 40° C., and then the resulting mixture was held at 6° C. overnight. The mixture was warmed to room temperature, and 20 g of a well-stirred mixture containing the AgBrI emulsion (11 g), Compound A (22 mg), and sensitizing dye IR-1 (7 mg) were added and held for 60 minutes. To the resulting mixture was added a solid-particle dispersion (23 g) of reducing agent DEV-1 (20%) that had been prepared using conventional milling techniques.

The above prepared mixture was coated onto a clear gelatin-subbed, 0.178-mm thick poly(ethylene terephthalate) support to give a wet coverage of 102 g/m$^2$ to provide a photothermographic material. On top of this photothermographic imaging layer was added a protective topcoat layer containing PVA, sulfo-1,4-bis(2-ethylhexyl) ester butanedioic acid, sodium salt, ZONYL FSN 100 nonionic surfactant, and an aqueous solution containing p-toluenesulfonic acid, tetraethylorthosilicate, and methanol.

Additional photothermographic materials were prepared using the same procedure except that inventive antifoggant compounds A-1, A-4, and A-7 were added at equivalent molar amounts using 2.5% aqueous solutions just prior to Compound B.

D) Aging, Exposure, and Development

The same aging, exposure, and development processes used for Example 6 were used.

TABLE IV

| Material | Antifoggant Compound | Antifoggant Amount (mg/m$^2$) | Aging Fog |
|---|---|---|---|
| Comparative 18 | 0 | 0 | 0.37 |
| Example 7 | A-1 | 38 | 0.21 |
| Example 8 | A-4 | 42 | 0.15 |
| Example 9 | A-7 | 42 | 0.27 |

Inventive antifoggant compounds A-1, A-4, and A-7 provided desirable stabilizing action during storage of photothermographic materials and there was no need for dissolution in organic solvents or preparation of costly milled dispersions.

EXAMPLES 10–14

A) Nanoparticulate Silver Behenate

The same silver behenate (NPSB) used for Example 6 was used.

B) AgBrI Imaging Emulsion

The same silver bromoiodide emulsion used for Examples 1–9 was used.

C) Preparation of Photothermographic Materials

An imaging composition to yield 0.1 kg of liquid mixture was prepared by mixing at 40° C. an aqueous solution of deionized bone gelatin (10.2 g of 35%), water (48.9 g), and Dispersion NPSB (28.9 g) and adjusting to pH 6.5. An aqueous solution (1.4 g) of sodium iodide (50 g/l) was added to the stirring mixture and held for 60 minutes, then the mixture was held at 30° C. for an additional 60 minutes. To this mixture was then added the AgBrI emulsion (0.64 g) with further holding for 30 minutes. Aqueous solutions of 4-methylphthalic acid (0.9 g of 10%) and phthalazine (1.3 g of 10%) were added to the stirred mixture. An hour later, a solid-particle dispersion (7.4 g) of reducing agent DEV-2 (20%) that had been prepared using conventional milling techniques was added.

The above prepared mixture was coated onto a clear, gelatin-subbed, 0.178-mm thick poly(ethylene terephthalate) support to give a wet coverage of 135 g/m$^2$ to provide a photothermographic material. On top of this photothermographic imaging layer was added a protective topcoat layer containing gelatin, sulfo-1,4-bis(2-ethylhexyl) ester butanedioic acid, sodium salt, and ZONYL FSN 100 nonionic surfactant.

Additional photothermographic materials were prepared using the same procedure except that inventive antifoggant compounds A-1, A-7, A-20, and A-25 were added using aqueous solutions just prior to phthalazine addition.

D) Aging and Development

Coatings of the prepared photothermographic materials were heat processed at 122° C. for 15 seconds to provide a silver image. The effect of accelerated aging was accomplished by placing samples of the photothermographic materials in a light-tight plastic box and holding them for 1 week at 50% relative humidity and 50° C. The results obtained after high temperature aging were compared with the results of samples of the same photothermographic materials that were developed without aging. The results are shown as Aging Fog in TABLE V wherein $D_{min}$ of the "fresh" samples was subtracted from the $D_{min}$ of the aged samples.

TABLE V

| Material | Antifoggant Compound | Antifoggant Amount ($mg/m^2$) | $D_{min}$ | Aging Fog |
|---|---|---|---|---|
| Comparative 19 | 0 | 0 | 0.62 | 0.78 |
| Comparative 20 | Compound B | 161 | 0.04 | 0.80 |
| Comparative 21 | Compound B | 312 | 0.05 | 0.90 |
| Comparative 22 | Compound E | 237 | 0.04 | 0.44 |
| Example 10 | A-1 | 280 | 0.05 | 0.30 |
| Example 11 | A-7 | 258 | 0.05 | 0.06 |
| Example 12 | A-20 | 215 | 0.15 | 1.09 |
| Example 13 | A-20 | 441 | 0.19 | 1.42 |
| Example 14 | A-25 | 237 | 0.04 | 0.02 |

Inventive antifoggant compounds A-1, A-7, A-20, and A-25 provided antifogging action relative to the comparative 19 coating containing no antifoggant. Inventive antifoggant compounds A-7 and A-25 gave superior fog inhibition during aging compared to Compounds B and E.

The invention has been described in detail with particular reference to certain preferred embodiments thereof, but it will be understood that variations and modifications can be effected within the spirit and scope of the invention.

We claim:

1. A photothermographic material comprising a support having thereon at least one imaging layer comprising a hydrophilic binder, and having in reactive association:

a) a photosensitive silver halide, b) a non-photosensitive source of reducible silver ions, and c) a reducing composition for said reducible silver ions, said photothermographic material further comprising:

d) an antifoggant that has a pKa of 8 or less and is represented by the following Structure I:

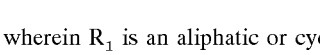

$$R_1—SO_2—C(R_2)R_3—(CO)_m—(L)_n—SG \quad \text{I}$$

wherein $R_1$ is an aliphatic or cyclic group, $R_2$ and $R_3$ are independently hydrogen or bromine as long as at least one of them is bromine, L is an aliphatic divalent linking group, m and n are independently 0 or 1, and SG is a solubilizing group having a pKa of 8 or less.

2. The photothermographic material of claim 1 wherein:

when m and n are both 0, SG is carboxy (or a salt thereof), sulfo (or a salt thereof), phospho (or a salt thereof), $—SO_2N^-COR_4M^+$, or $—N^-SO_2R_4M^+$, when m is 1 and n is 0, SG is carboxy (or a salt thereof), sulfo (or a salt thereof), phospho (or a salt thereof), or $—N^-SO_2R_4M^+$, when m and n are both 1, SG is carboxy (or a salt thereof), sulfo (or a salt thereof), phospho (or a salt thereof), or $—SO_2N^-COR_4M^+$, and $R_4$ is an aliphatic or cyclic group, and $M^+$ is a cation other than a proton.

3. The photothermographic material of claim 1 wherein said SG is a sulfo, phospho, sulfonamido, or carboxy group or a salt thereof when m and n are each 1.

4. The photothermographic material of claim 1 wherein m and n are both 0.

5. The photothermographic material of claim 1 wherein both $R_2$ and $R_3$ are bromine, and SG is a sulfo or carboxy group, or a salt thereof.

6. The photothermographic material of claim 1 wherein $R_1$ is 4-methylphenyl, phenyl, trifluoromethyl, adamantyl, or tertiary butyl.

7. The photothermographic material of claim 1 wherein m and n are each 1 and L is an $—N(CH_3)$-alkylene- or —NH-alkylene-group.

8. The photothermographic material of claim 1 wherein said antifoggant is one or more of the following compounds A-1 to A-25:

A-1

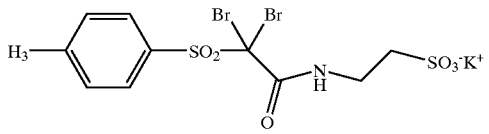

A-2

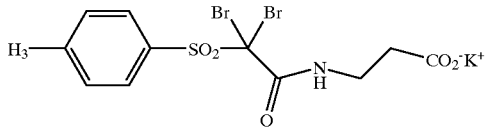

A-3

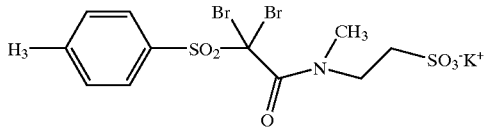

A-4

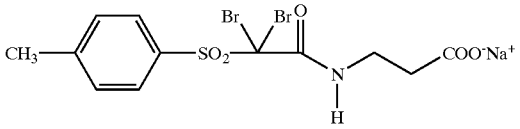

A-5

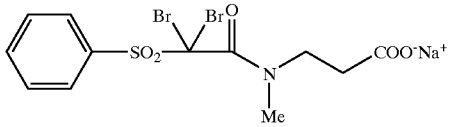

A-6

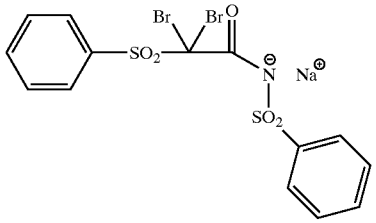

A-7

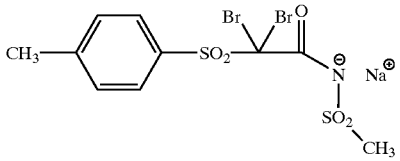

A-8

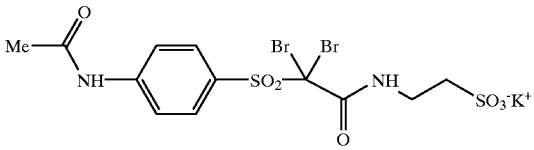

A-9

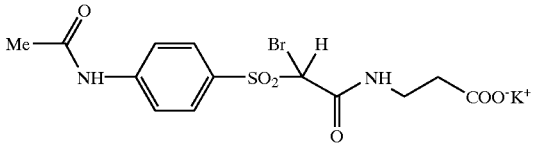

-continued
A-10
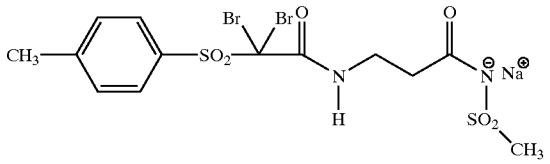
A-11
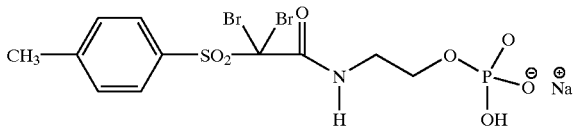
A-12
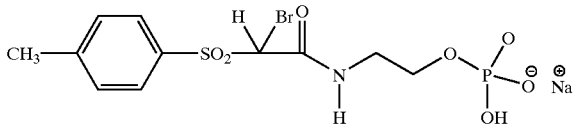
A-13
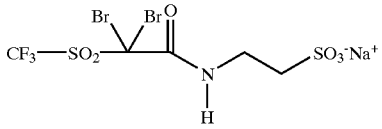
A-14
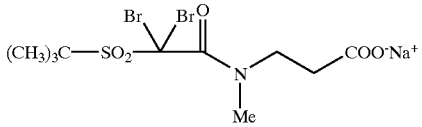
A-15
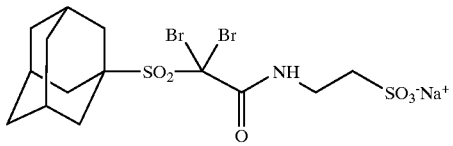
A-16
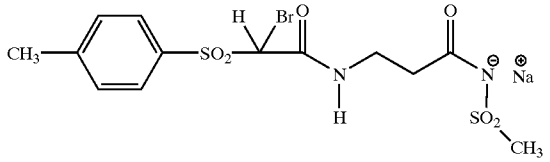
A-17
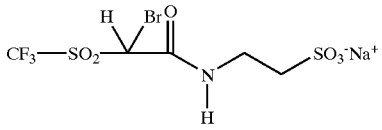
A-18
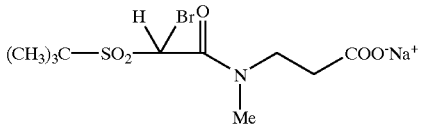
A-19
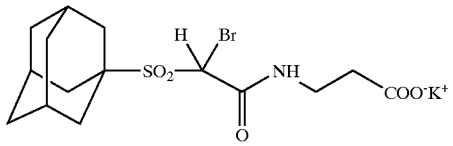
-continued
A-20
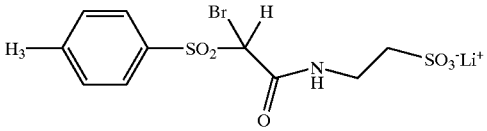
A-21
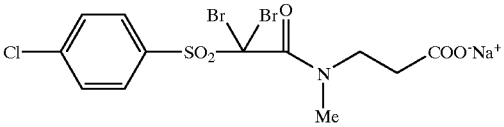
A-22
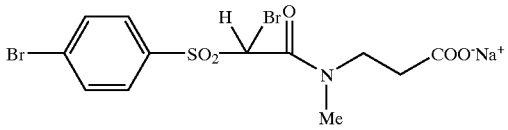
A-23
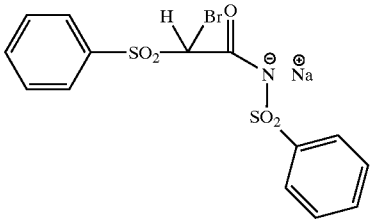
A-24
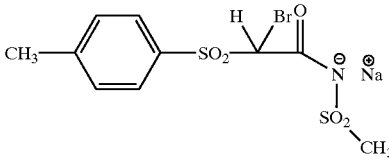
A-25
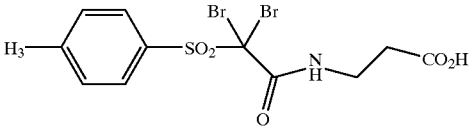
A-26
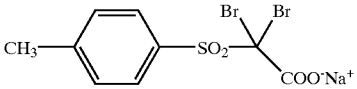
A-27
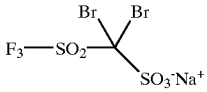
A-28
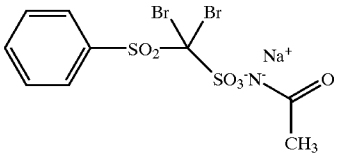
A-29
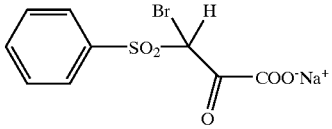
A-30
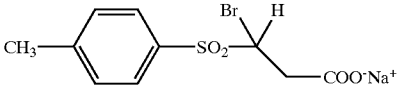

-continued

A-31

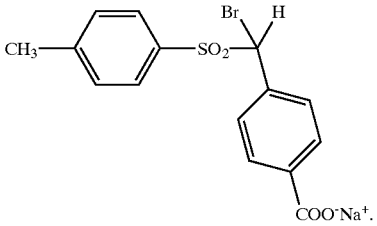

9. The photothermographic material of claim 1 wherein non-photosensitive source of reducible silver ions is a silver salt provided in an aqueous nanoparticulate dispersion.

10. The photothermographic material of claim 9 wherein said non-photosensitive source of reducible silver ions is a silver carboxylate of a long chain fatty acid having 8 to 30 carbon atoms in the fatty acid chain, or mixture of such silver carboxylates, at least one of which is silver behenate.

11. The photothermographic material of claim 1 wherein said reducing composition comprises at least one hindered phenol.

12. The photothermographic material of claim 1 that is sensitive to radiation of from about 400 to about 850 nm.

13. The photothermographic material of claim 1 wherein said hydrophilic binder is polyvinyl alcohol, gelatin, or a gelatin derivative.

14. The photothermographic material of claim 1 further comprising a surface protective overcoat on the imaging side of said support, an antihalation layer on the backside of said support, or both.

15. A photothermographic material comprising a transparent support having thereon an aqueous-based imaging layer comprising gelatin or a gelatin derivative as binder, and having in reactive association:

a) photosensitive silver bromide, silver iodobromide, or both, b) a non-photosensitive source of reducible silver ions that is one or more silver carboxylates provided as an aqueous nanoparticulate dispersion, c) a reducing composition for said reducible silver ions that includes a bis-phenol, and d) a water-soluble antifoggant that has a pKa of 8 or less and is represented by the following Structure I:

$$R_1—SO_2—C(R_2)R_3—(CO)_m—(L)_n—SG \qquad \text{I}$$

wherein $R_1$ is substituted or unsubstituted phenyl group, $R_2$ and $R_3$ are both bromine, L is a —NH-alkylene group wherein "alkylene" has 1 to 3 carbon atoms, SG is carboxy or sulfo group or a salt thereof, and m and n are both 1, said photothermographic material further comprising an aqueous-based surface protective overcoat over said imaging layer, and an aqueous-based antihalation layer on the backside of said support.

16. The photothermographic material of claim 15 wherein said antifoggant is one or more of the following compounds A-1 to A-25:

A-1

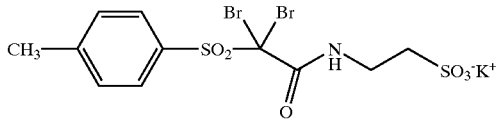

A-2

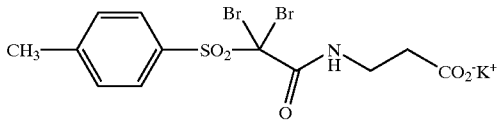

A-3

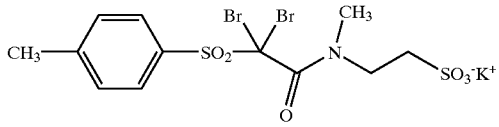

A-4

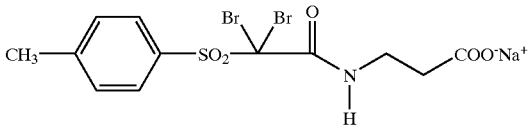

A-5

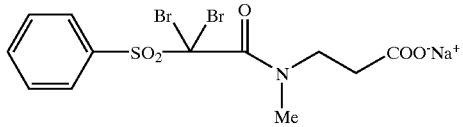

A-6

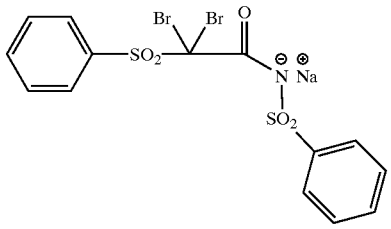

A-7

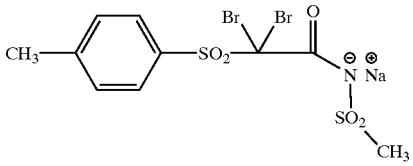

A-8

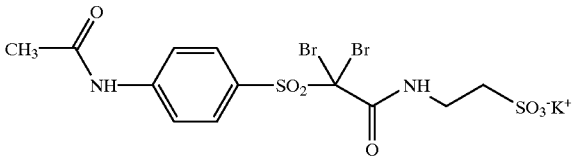

A-9

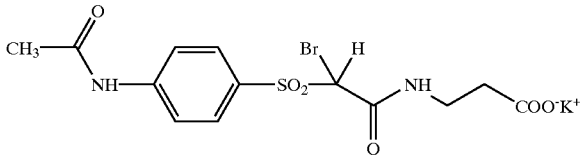

-continued
A-10
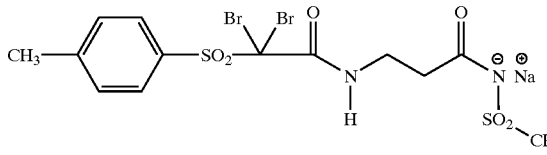
A-11
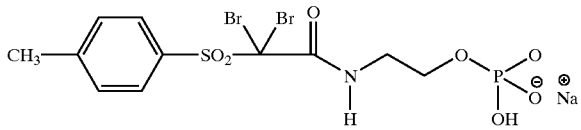
A-12
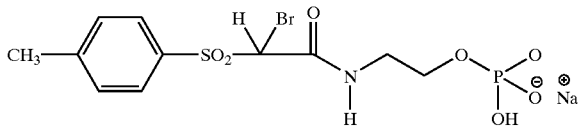
A-13
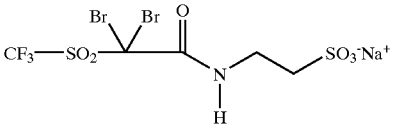
A-14
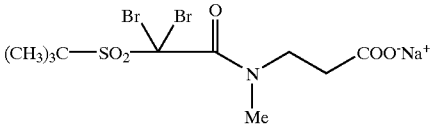
A-15
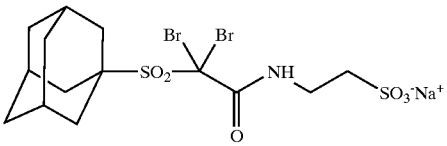
A-16
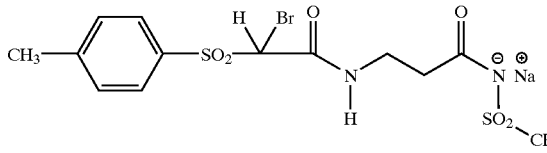
A-17
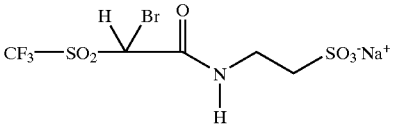
A-18
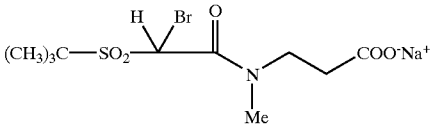
A-19
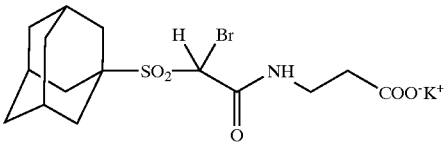
-continued
A-20
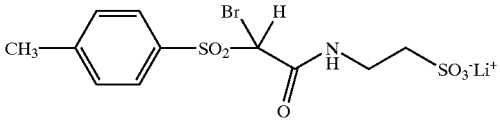
A-21
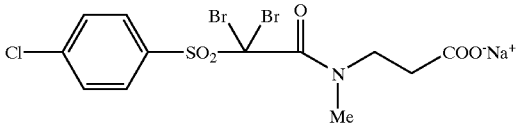
A-22
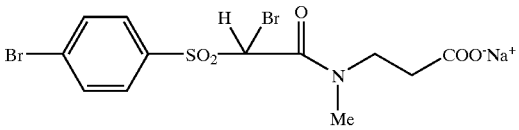
A-23
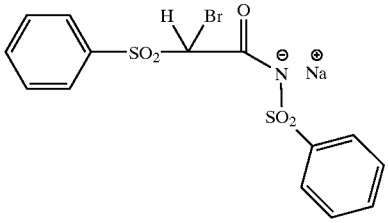
A-24
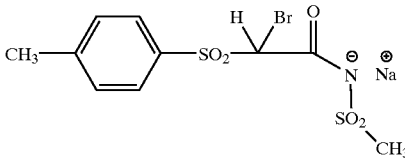
A-25
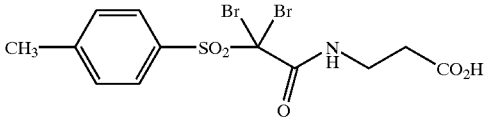
A-26
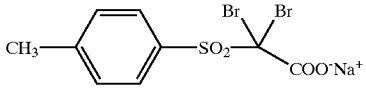
A-27
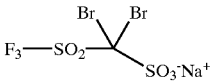
A-28
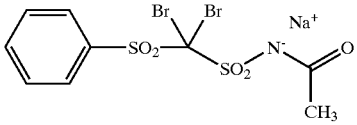
A-29
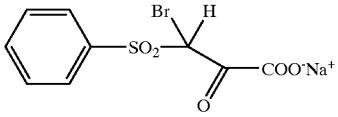
A-30
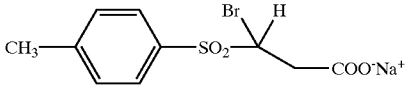

-continued

A-31

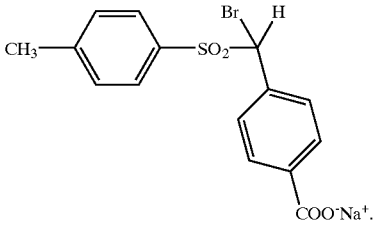

17. A method of forming a visible image comprising:

A) imagewise exposing the photothermographic material of claim 1 to electromagnetic radiation at a wavelength greater than 400 nm to form a latent image, B) simultaneously or sequentially, heating said exposed photothermographic material to develop said latent image into a visible image.

18. The method of claim 17 wherein said photothermographic material comprises a transparent support, and said image-forming method further comprising:

C) positioning said exposed and heat-developed photothermographic material between a source of imaging radiation and an imageable material that is sensitive to said imaging radiation, and D) thereafter exposing said imageable material to said imaging radiation through the visible image in said exposed and heat-developed photothermographic material to provide a visible image in said imageable material.

* * * * *

UNITED STATES PATENT AND TRADEMARK OFFICE

CERTIFICATE OF CORRECTION

PATENT NO. : 6,514,678 B1 
DATED : February 4, 2003
INVENTOR(S) : George J. Burgmaier et al.

It is certified that error appears in the above-identified patent and that said Letters Patent is hereby corrected as shown below:

Column 40,
Replace Compound A-1 with

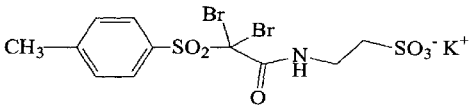

A-1

Replace Compound A-2 with

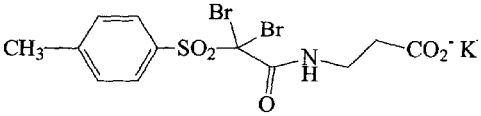

A-2

Replace Compound A-3 with

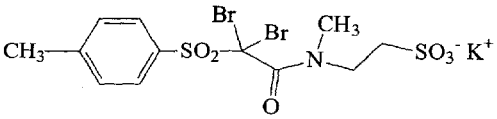

A-3

Replace Compound A-25 with

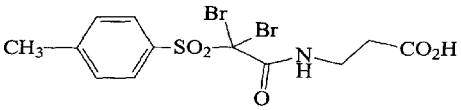

A-25

Replace Compound A-27 with

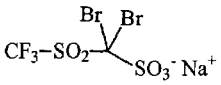

A-27

Column 42,
Replace Compound A-20 with

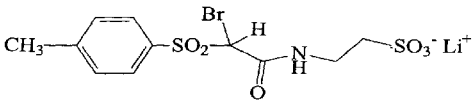

A-20

Column 46,
Replace Compound A-27 with

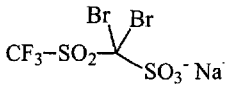

A-27

Signed and Sealed this

Twenty-sixth Day of August, 2003

JAMES E. ROGAN
*Director of the United States Patent and Trademark Office*